US011118408B2

(12) United States Patent
Marshall et al.

(10) Patent No.: US 11,118,408 B2
(45) Date of Patent: Sep. 14, 2021

(54) DOWNHOLE STEERING SYSTEM AND METHODS

(71) Applicant: Novatek IP, LLC, Provo, UT (US)

(72) Inventors: Jonathan D. Marshall, Springville, UT (US); Edward George Parkin, Stonehouse (GB); Geoffrey Charles Downton, Stonehouse (GB); David C. Hoyle, Salt Lake City, UT (US); Nalin Weerasinghe, Sugar Land, TX (US); Dennis Patrick Chestnutt, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/621,765

(22) PCT Filed: Jun. 26, 2018

(86) PCT No.: PCT/US2018/039376

§ 371 (c)(1),
(2) Date: Dec. 12, 2019

(87) PCT Pub. No.: WO2019/005709

PCT Pub. Date: Jan. 3, 2019

(65) Prior Publication Data

US 2020/0141188 A1 May 7, 2020

Related U.S. Application Data

(60) Provisional application No. 62/525,121, filed on Jun. 26, 2017, provisional application No. 62/525,140,
(Continued)

(51) Int. Cl.
*E21B 7/06* (2006.01)
*E21B 23/00* (2006.01)
(Continued)

(52) U.S. Cl.
CPC ..... *E21B 7/062* (2013.01); *E21B 23/006* (2013.01); *E21B 34/16* (2013.01); *E21B 47/024* (2013.01); *E21B 4/003* (2013.01)

(58) Field of Classification Search
CPC ..... E21B 4/003; E21B 7/062; E21B 23/006; E21B 34/16; E21B 47/024
(Continued)

(56) References Cited

U.S. PATENT DOCUMENTS 6,116,354 A 9/2000 Buytaert
2013/0032401 A1 2/2013 Edbury et al.
(Continued)

OTHER PUBLICATIONS

International Search Report and Written Opinion issued in International Patent application PCT/US2019/039376 dated Oct. 29, 2018, 19 pages.
(Continued)

*Primary Examiner* — Taras P Bemko

(57) ABSTRACT

A downhole steering system includes a substantially tubular housing, a shaft positioned within the substantially tubular housing, a first bearing and a second bearing, the first and second bearings being configured to support rotation of the shaft relative to the housing. The first bearing, the second bearing, the shaft, and the housing at least partially define a chamber therebetween. The system also includes at least one structure positioned axially between a the first and second bearing and being configured to extend from an exterior of the housing in response to pressure communicated to the chamber.

18 Claims, 17 Drawing Sheets

Related U.S. Application Data filed on Jun. 26, 2017, provisional application No. 62/525,143, filed on Jun. 26, 2017, provisional application No. 62/525,148, filed on Jun. 26, 2017.

(51) Int. Cl.
*E21B 34/16* (2006.01)
*E21B 47/024* (2006.01)
*E21B 4/00* (2006.01)

(58) Field of Classification Search
USPC ..... 175/45
See application file for complete search history.

(56) References Cited

U.S. PATENT DOCUMENTS

| | | | |
|---|---|---|---|
| 2015/0008045 | A1 | 1/2015 | Downton |
| 2016/0060960 | A1 | 3/2016 | Parkin et al. |
| 2016/0160567 | A1 | 6/2016 | Downton |

OTHER PUBLICATIONS

First Office Action and Search Report issued in Chinese Patent Application 201880051550.2 dated Mar. 29, 2021, 7 pages.

DOWNHOLE STEERING SYSTEM AND METHODS

CROSS-REFERENCE TO RELATED APPLICATIONS

This application claims priority to U.S. Provisional Patent Applications having Ser. Nos. 62/525,121; 62/525,140; 62/525,143; and 62/525,148, each of which was filed on Jun. 26, 2017. The entire contents of each these priority provisional applications is incorporated herein by reference.

BACKGROUND

Exploring for and extracting oil, gas, or geothermal energy deposits from the earth often involves boring subterranean holes. To do so, it is common to secure a drill bit to the end of a drill string suspended from a derrick. The drill bit may be rotated to engage and degrade the earth forming a wellbore therein and allowing the drill bit to advance. It may often be desirable to direct a drill bit toward a deposit or away from an obstruction as it advances through the earth. To do so, a rotational axis of the drill bit must typically be offset from a centerline of its respective borehole such that the drill bit engages one side of the borehole more than another. Furthermore, it is not uncommon for a rotational axis of a drill bit to deviate from a centerline of a borehole on its own, causing the borehole to diverge from its intended path. Thus, it may be advantageous to steer a drill bit back toward the centerline of its respective borehole.

Accordingly, various downhole steering systems have been developed for the purpose of actively shifting a drill bit axis from a borehole centerline or returning it thereto. Such downhole steering systems have utilized a variety of different techniques. One common technique is to push off of an inner wall of a wellbore through which a drill bit is traveling in a direction opposite from where the drill bit is intended to go. For example, a structure may be extended radially from a side of a drill string, push against an inner wall of a wellbore and urge a drill bit in an opposite radial direction. As the drill bit is urged radially, it may tend to degrade the wellbore unevenly causing it to veer in a desired direction.

It has been found that the closer an extendable structure is placed to a drill bit, the greater affect its extension may have on the drill bit. Thus, several attempts have been made to place extendable structures as close as possible to their respective drill bits. However, such placement often leaves little room for other equipment, such as control systems and the like. In many instances, positioning of control systems or other equipment far from extendable structures complicates electrical wiring and/or fluid channeling.

SUMMARY

Embodiments of the disclosure may provide a downhole steering system including a substantially tubular housing, a shaft positioned within the substantially tubular housing, a first bearing and a second bearing, the first and second bearings being configured to support rotation of the shaft relative to the housing. The first bearing, the second bearing, the shaft, and the housing at least partially define a chamber therebetween. The system also includes at least one structure positioned axially between the first and second bearing and being configured to extend from an exterior of the housing in response to pressure communicated to the chamber.

Embodiments of the disclosure may also provide a drilling system including a drill bit, a shaft coupled to the drill bit, wherein rotation of the shaft causes the drill bit to rotate, and a substantially tubular housing positioned around at least a portion of the shaft. The shaft and the drill bit are rotatable relative to the housing. The system also includes a first bearing and a second bearing, the first and second bearings being configured to support rotation of the shaft relative to the housing. The first bearing, the second bearing, the shaft, and the housing at least partially define a chamber therebetween. The system further includes one or more radially-extendable pistons positioned axially between the first and second bearings and in pressure communication with the chamber, the one or more pistons being configured to extend outward of an exterior of the housing in response to pressure communicated to the chamber, and a valve configured to control pressure communication between the chamber and the radially-extendable pistons.

Embodiments of the disclosure may also provide a method for steering a drill bit, including deploying drill bit and a downhole steering system into a wellbore. The system includes a substantially tubular housing, a shaft positioned within the substantially tubular housing, a first bearing and a second bearing, the first and second bearings being configured to support rotation of the shaft relative to the housing. The first bearing, the second bearing, the shaft, and the housing at least partially define a chamber therebetween. The system also includes at least one structure positioned axially between the first and second bearing and being configured to extend from an exterior of the housing in response to pressure communicated to the chamber. The method also includes flowing drilling fluid into the downhole steering system such that the shaft is rotated relative to the tubular housing, wherein rotation of the shaft causes the drill bit to rotate, and actuating a valve so as to allow pressure communication between the chamber and the at least one structure, such that the at least one extendable structure extends radially outward and engages a wellbore.

Embodiments of the disclosure may provide a method for steering a downhole system including placing a drill string in a well, the drill string including a drill bit and a motor, the motor including a shaft connected to the drill bit and a stator housing in which the shaft is positioned. At least one structure is radially extendable from the stator housing. The method also includes passing drilling fluid from an inlet of the wellbore along the drill string and between the shaft and the stator housing. Passing the drilling fluid between the shaft and the stator housing causes the shaft to rotate the drill bit relative to the stator housing. The method further includes holding the stator housing rotationally stationary, and selectively communicating a pressure of the drilling fluid to the structure via a port extending radially through the stator, so as to extend the structure radially outward against a wall of the wellbore, and alter a trajectory of the drill bit.

Embodiments of the disclosure may provide a downhole steering system including a substantially tubular housing comprising a longitudinal axis and an exterior, a shaft coupled to a drill bit, extending through the housing, and rotatable relative to the housing, and a first structure, a second structure, and a third structure. The first, second, and third structures are extendable outward of the exterior of the housing. The first structure is circumferentially offset from the second and third structures. The first, second, and third structures are positioned along an angular interval of less than about 120 degrees as proceeding around the housing.

Embodiments of the disclosure may also provide a drilling system including a drill bit, a substantially tubular housing comprising a longitudinal axis and an exterior, a shaft coupled to the drill bit, extending through the housing, and rotatable relative to the housing, wherein rotation of the shaft causes the drill bit to rotate, and a first structure, a second structure, and a third structure. The first, second, and third structures are extendable outward of the exterior of the housing, the first structure being circumferentially offset from the second and third structures. The first, second, and third structures are positioned along an angular interval of less than about 120 degrees as proceeding around the housing.

Embodiments of the disclosure may further provide A method for steering a drill bit, which includes flowing a drilling fluid between a housing and a shaft, such that the shaft is caused to rotate relative to the housing, with rotating the shaft causing the drill bit to rotate. The method also includes holding the housing rotationally stationary with respect to a rock formation, and while holding the housing rotationally stationary, selectively communicating pressure to at least three extendable structures coupled to the housing. Communicating pressure to the at least three extendable structures causes the structures to extend outwards and engage the rock formation. The at least three extendable structures each define central axes, the central axes being angularly offset from one another. The at least three extendable structures are positioned along an angular interval of less than about 120 degrees as proceeding around the housing.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

FIG. 4-1 is a cross-sectional view of an embodiment of a downhole steering system.

FIG. 4-2 is perspective view of another embodiment of a downhole steering system.

FIG. 4-3 is a longitude-sectional view of an embodiment of a drill bit and a downhole steering system.

FIG. 5-1 is a longitude-sectional view of an embodiment of a drill string wherein a mass may block and unblock an opening leading to a pressurized chamber based on rotation of the drill string.

FIG. 5-2 is a longitude-sectional view of an embodiment of a drill string wherein a mass may block and unblock an opening leading to a pressurized chamber based on a flow rate of drilling fluid passing through the drill string.

FIG. 5-3 is a longitude-sectional view of an embodiment of a drill string wherein a plurality of balls traveling within drilling fluid passing through the drill string may get caught in a slidable trap that may block an opening leading to a pressurized chamber.

FIG. 5-4 is a schematic view of an embodiment of a pin that may travel in a cam slot to index between blocking and unblocking positions.

FIG. 5-5 is a longitude-sectional view of an embodiment of a drill string wherein a disk may be ruptured by an increase in drilling fluid pressure to bypass a pressurized chamber.

FIG. 6-1 is a longitude-sectional view of an embodiment of a control mechanism comprising a direction and inclination sensor.

FIG. 6-2 is a longitude-sectional view of an embodiment of a control mechanism including a formation property sensor.

FIG. 6-3 is a longitude-sectional view of an embodiment of a control mechanism including an acoustic receiver.

FIG. 6-4 is a longitude-sectional view of an embodiment of a control mechanism including a pressure sensor.

FIG. 6-5 is a schematic representation of an embodiment of a control mechanism including a communications wire.

FIGS. 7-1, 7-2 and 7-3 are perspective views of different embodiments of bearings.

FIGS. 8-1 and 8-2 are perspective views of embodiments of a three-dimensional printing operation and coating operation, respectively.

FIGS. 9-1 and 9-2 are orthogonal views of different embodiments of bearings while FIG. 9-3 is a longitude-sectional view of an embodiment of another type of bearing.

FIG. 10-1 is a magnified longitude-sectional view of an embodiment of an axial support ring while FIG. 10-2 is a longitude-sectional view of an embodiment of a flow restrictor and filter.

FIG. 15-1 illustrates a sectional view of an embodiment of a ratcheting valve device.

FIG. 15-2 illustrates a perspective view of an embodiment of a valve element for the ratcheting valve device.

FIG. 15-3 illustrates a perspective view of an embodiment of a downhole steering system including the ratcheting valve device.

FIGS. 17-1 and 17-2 illustrate perspective views of two other embodiments of a steering system.

DETAILED DESCRIPTION

Figure 1:
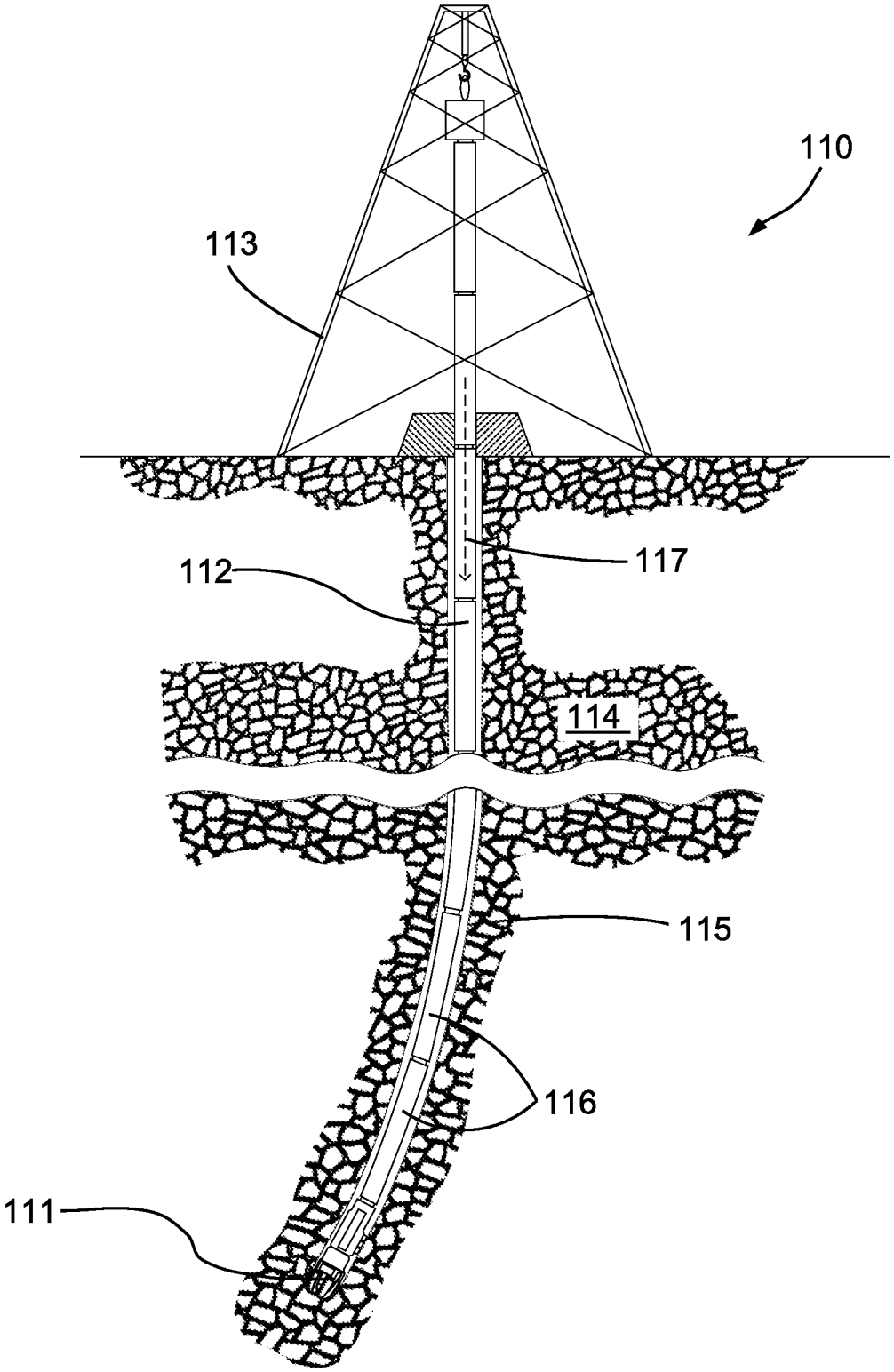
FIG. 1 is an orthogonal view of an embodiment of an earth-boring operation.

FIG. 1 shows an embodiment of an earth-boring operation 110 that may be used when exploring for or extracting oil, gas or geothermal energy deposits from the earth. The earth-boring operation 110 may include a drill bit 111 secured to one end of a drill string 112 suspended from a derrick 113. The drill bit 111 may be rotated to degrade subterranean formations 114, forming a wellbore 115 therein and allowing the drill bit 111 to advance.

The drill string 112 may be formed from a plurality of drill pipe sections 116 fastened together end-to-end, each configured to pass a drilling fluid 117 therethrough. The drilling fluid 117 may be pumped through the drill string 112 from an inlet of the wellbore 115 and expelled from nozzles on the drill bit 111. The drilling fluid 117 may serve a variety of purposes, including carrying earthen debris away from the drill bit 111, cooling and lubricating the drill bit 111 and powering a variety of downhole tools.

Figure 2:
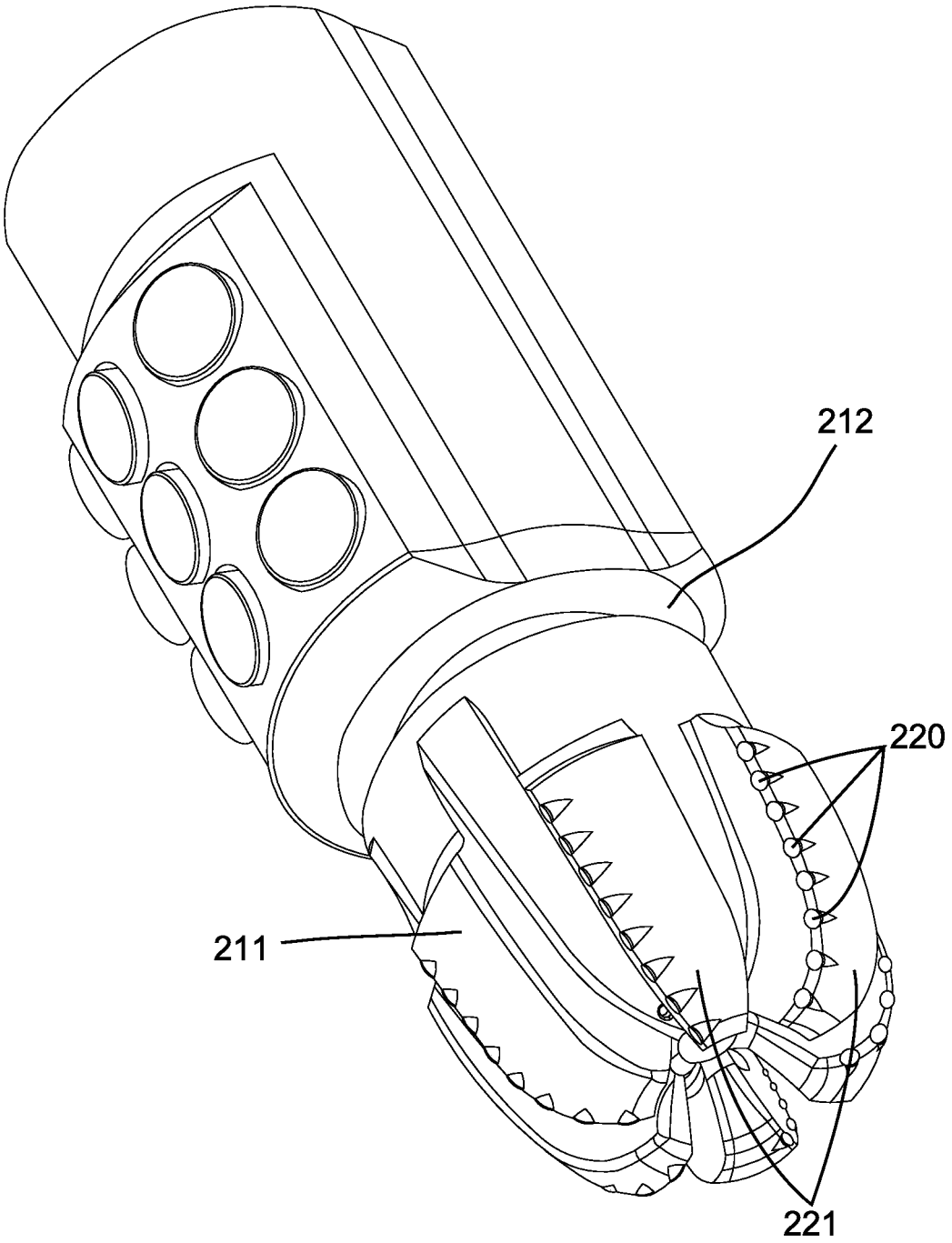
FIG. 2 is a perspective view of an embodiment of a drill bit and a downhole steering system.

FIG. 2 shows an embodiment of a drill bit 211 secured on an end of a drill string 212. The drill bit 211 may comprise a plurality of cutters 220 arranged on distal edges of a plurality of blades 221 extending from and spaced about the drill bit 211. As the drill bit 211 is rotated the cutters 220 may engage and degrade an earthen formation. A variety of known drill bit styles may be swapped for the style shown and perform similarly.

Figure 3:
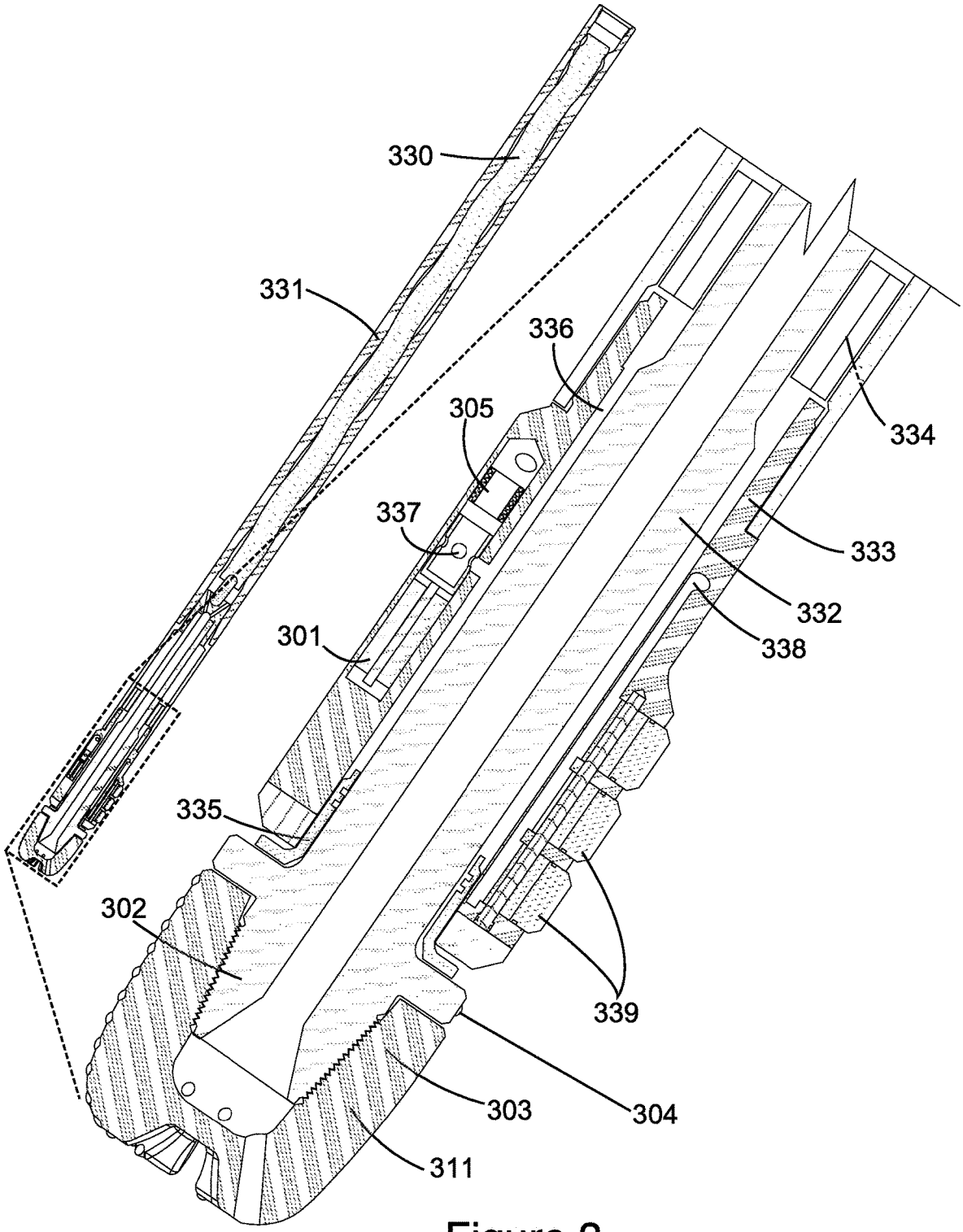
FIG. 3 is a longitude-sectional view of an embodiment of a drill bit, a motor, and a downhole steering system.

The drill bit 211 may be rotated by a motor. FIG. 3 shows an embodiment of a motor, which may be powered by drilling fluid, including a shaft 330 positioned within a substantially tubular housing 331. As is typical in progressive cavity positive displacement type motors, the shaft 330 may have a helical exterior geometry with two or more lobes disposed thereon. The housing 331 may have a helical interior geometry also with two or more lobes disposed thereon. If the housing 331 includes more lobes than the shaft 330, then drilling fluid passing along a drill string passing between the exterior geometry of the shaft 330 and the interior geometry of the housing 331 may cause the shaft 330 to rotate eccentrically relative to the housing 331. In this way the shaft 330 may act as a rotor and the housing 331 may act as a stator of the motor. While a progressive cavity positive displacement motor is shown in this embodiment, other types of motors, such as a turbine motor, may produce a similar result. The housing 331 may be provided as two or more tubular members that are secured together, or as one integral piece. Similarly, the shaft 330 may be one integral piece, or two or more cylinders that are rigidly or otherwise coupled together.

Another example of a downhole tool that may be powered by drilling fluid is a steering system. FIG. 3 also shows an embodiment of steering system including a shaft 332 positioned within a substantially tubular housing 333, similar to the motor. First and second bearings 334, 335 may be axially spaced from one another, disposed between an exterior of the shaft 332 and an interior of the housing 333. The first and second bearings 334, 335 may support the shaft 332 within the housing 333 allowing the shaft 332 to rotate relative thereto while reducing friction and wear therebetween. Together, the first and second bearings, 334, 335, shaft 332 and housing 333 may define the boundaries of a chamber 336 configured to maintain pressurized drilling fluid therein. Fluid within the chamber 336 may be channeled through a valve 337 and a passage 338 to a plurality of pads 339 (or other radially-extendable structures) configured to extend from an exterior of the housing 333 when adequately pressurized from within. When extended, the plurality of pads 339 may push against a wall of a wellbore in which the housing 333 is positioned, thus shifting a rotational axis of a drill bit 311 away from or toward a wellbore centerline. Such pushing may be timed and executed to change or maintain a trajectory of advancement of the drill bit 311. The pads 339 may be rotationally fixed to the tubular housing 333, such that they may be positioned by rotation of a drill string at an inlet to a wellbore. In such a configuration, the drill bit 311 may be rotatable relative to the pads 339 and the tubular housing 333.

The pads 339 may be positioned in a variety of arrangements. For instance, in one embodiment shown in FIG. 4-1, at least three pads 439-1 may be extendable from an exterior of a substantially tubular housing 433-1 such that each of the pads 439-1 remains within an angular range 440-1 of one-third of a full rotation about an axis of the housing 433-1 (e.g., about 120 degrees), whether the pads 439-1 are extended or retracted. While an angular range of one-third is shown, other embodiments may define ranges of one-quarter (80 degrees) to one-half (180 degrees). Such an arrangement of pads 439-1 may allow for sufficient force to be applied by the pads 439-1 to an adjacent wellbore without blocking drilling fluid flow down the housing 433-1 or up an annulus surrounding the housing 433-1.

A cylindrical orifice 447-1 within the housing 433-1 and configured to carry drilling fluid may extend longitudinally through the housing 433-1, uninterrupted by the pads 439-1. Also, at least one fluid channel 441-1 may run longitudinally along the exterior of the housing 433-1 configured to carry drilling fluid through the wellbore. This particular embodiment includes two such fluid channels, each disposed between the pads 439-1 and a point on the exterior of the housing 433-1 opposite the pads 439-1 relative to the axis, e.g., along flattened sections of the exterior of the housing 433-1. A distance 450-1, between respective nadirs of the two fluid channels, may be greater than a widest span of the pads 439-1. Due to the spacing of the pads 439-1, a sum of such fluid channels may be an angular range of over two-fifths of a full rotation about the housing 433-1 axis and over 8% of a cross-sectional footprint area of the housing 433-1 allowing for adequate fluid flow. In some embodiments, the angular range may be between three-tenths and one-half, and the percentage of the cross-sectional footprint area over 6%. A surface 442-1 forming the fluid channel 441-1 may be substantially perpendicular to a radius of the housing 433-1 and parallel to the axis thereof.

Figures 1, 4:
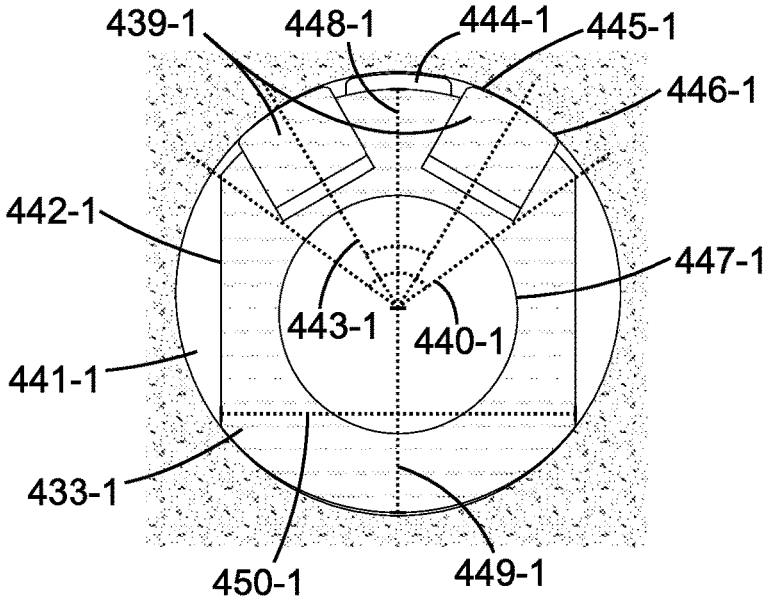
Figures 2, 4:
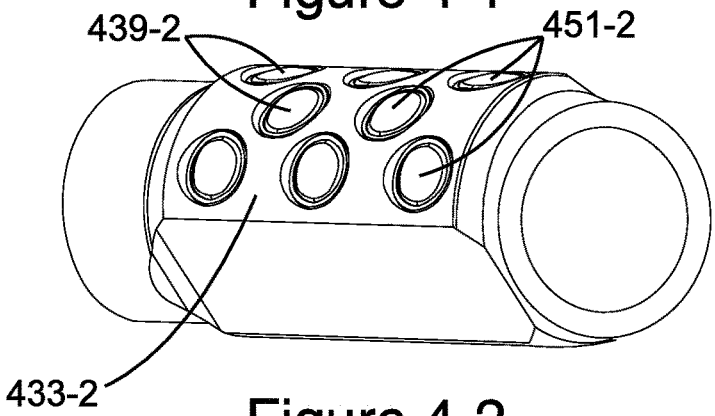
Figures 3, 4:
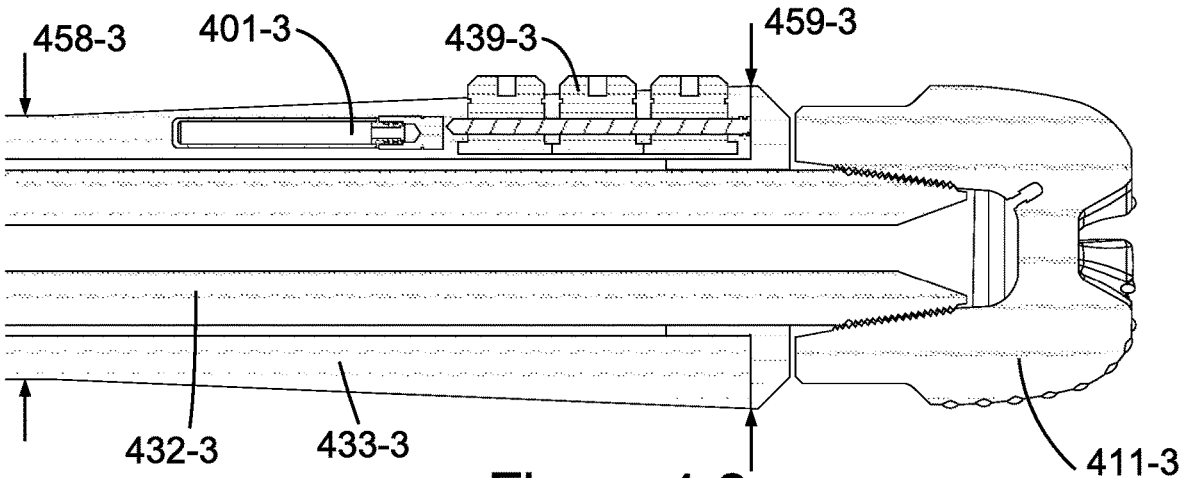

As also shown in the embodiment of FIG. 4-1, at least two of the pads 439-1 may define axes disposed substantially on a single plane (the cross-section shown) perpendicular to the axis of the housing 433-1. For example, three pads sharing a single perpendicular plane are shown in FIG. 2. The axes of the at least two pads 439-1 may be disposed within an angular range 443-1 of one-fifth (about 72 degrees) of a full rotation about the housing 433-1 axis. In some embodiments, such an angular range may fall between one-tenth (36 degrees) and three-tenths (108 degrees) of a full rotation. Furthermore, one pad 444-1 defines an axis disposed perpendicular to the axis of the housing 433-1 and substantially midway between the axes of the other two pads 439-1.

These respective pads 439-1, 444-1 may include a distal end shaped generally as a circular arc when viewed in a plane (the cross section shown) perpendicular to the axis of the housing 433-1. Furthermore, the circular arcs of each of the pads 439-1, 444-1 may share the same radius and center. In the embodiment shown, the circular-arc distal-end geometry of the center pad 444-1 may be generally symmetrical about its axis. This distal end shape may differ from distal ends of the other two pads 439-1 that may be asymmetrical about their respective axes when viewed in the same plane. More specifically, the distal ends of the other two pads 439-1 may extend farther from the axis of the housing 433-1 on sides facing each other 445-1 than on opposite sides 446-1. This may be because the center of the circular arcs of each of the pads 439-1, 444-1 is offset from the axis of the housing 433-1. In the embodiment shown, this offset equals the length of maximum extension of the pads 439-1, 444-1 from the exterior. In some embodiments, such an offset may result in less wear, especially on peripheral edges of the pads 439-1, 444-1.

As also shown in this embodiment, the exterior of the housing 433-1 immediately adjacent the pads 439-1 may extend a greater distance 448-1 from the axis than a distance 449-1 to a point on the exterior opposite from the axis, and a lesser distance 448-1 than a length of a radius of a drill bit secured to a shaft passing through the housing 433-1. In some embodiments, the housing 433-1 may be configured such that a difference, between this greater distance 448-1 and the distance 449-1 to the opposite point, is substantially equal to a length of maximum extension of the pads 439-1; however, other designs may also be employed. Also, in some embodiments, the housing 433-1 may be designed such that a sum of these two distances 448-1, 449-1 is less than a diameter of a drill bit secured to an end of a shaft passing through the housing 433-1.

FIG. 4-2 shows one embodiment of the pads 439-2 arranged on an exterior of a substantially tubular housing 433-2. As shown, sets 451-2 of three pads 439-2, each extendable from the exterior, may be spaced longitudinally along the housing 433-2. Each of the sets 451-2 may include one pad positioned equidistant and axially displaced, in a staggered configuration, between pairs of double pads spaced longitudinally along the housing 433-2. In other embodiments, other configurations are possible, such as rows of double pads without center pads. While the illustrated embodiment includes eight extendable pads, other embodiments may have from one to twelve pads, such as three, nine (such as shown in FIG. 2), eleven or any other suitable number of pads. In addition, while two specific configurations have been shown in FIG. 2 and FIG. 4-2, any suitable configuration may be used. For example, pads could be located on any suitable number (such as one to four or more) of axial rows and (one to five or more) circumferential rows.

FIG. 4-3 shows an embodiment of a drill bit 411-3 secured to a shaft 432-3 positioned within a housing 433-3. The housing 433-3 may include a plurality of extendable pads 439-3 disposed on the same side of the housing 433-3 as a control mechanism 401-3. Specifically, the control mechanism 401-3 may be positioned within the same angular range, one-third of a full rotation about the housing 433-3, as the pads 439-3. As also can be seen in this embodiment, to make space for the housing 433-3 when located within a curved wellbore, an exterior of the housing 433-3 may taper longitudinally from a diameter 459-3 adjacent the drill bit 411-3 to a diameter 458-3 closer to a drill string secured to the housing 433-3 opposite the drill bit 411-3.

As described, timing and execution of pad extension may be performed by a control mechanism (also referred to herein as a "control device") 301 disposed axially between the first bearing 334 and the second bearing 335, as shown in FIG. 3. Various embodiments of control mechanisms may incorporate different control regimen, as will be described in more detail below. For example, the control mechanism 301 may actuate the valve 337 to affect the timing and duration of pressure on or stroke length of the pads 339. This could be done by the control mechanism 301 without the aid of external information.

In some embodiments, all pads may be actuated together, groups of pads may be actuated together, or individual pads may be actuated. To determine how much pressure or stroke length is desirable, a variety of sensors may gather information and feed it to such a control mechanism. For instance, some embodiments of sensors, such as inclinometers and magnetometers, may determine position or orientation of a drill string or pads. A control mechanism may then use this information in deciding when and how to actuate a valve. Other embodiments of sensors may detect formation properties of a wellbore surrounding the drill string. Such information may provide addition layers of information to assist a control mechanism. As such, a control mechanism may manipulate a valve with proportional, nonlinear, or on/off actuation in order to achieve a chosen outcome.

In various embodiments, a resting position of such pads, before extending, may be either generally flush with our sunken within an exterior of the housing. In other embodiments, however, the pads at rest may protrude from the exterior of the housing to provide a resting outward offset, such that the pads may be either extended or retracted from that position to provide additional steering control. Also, in assorted embodiments, such a plurality of pads may extend together, at least one of the pads may extend separately from the rest, or at least one of the pads may remain continuously extended.

In this configuration, pressurized drilling fluid may be channeled to the plurality of pads 339 without needing to bypass either of the first or second bearings 334, 335. Specifically, the pressurized drilling fluid traveling from the chamber 336 to the pads 339 may be continuously maintained axially between the first bearing 334 and the second bearing 335.

Even without the valve 337, a downhole steering system of the type shown may be operated by holding the housing 333 rotationally stationary at an inlet of a wellbore, passing drilling fluid from the inlet along a drill string until it reaches the plurality of pads 339, and pressing the pads 339 outwards with pressure from the drilling fluid. Because the housing 333 is held, the pads 339 may generally extend in a constant orientation thus altering a trajectory of the drill bit 311. A rate of alteration may be controlled by adjusting a pressure of the drilling fluid at the inlet.

When straight drilling is desired, the drill string may be rotated at the inlet. Even with the pads 339 extended, rotation may generally balance out or negate their effect on drilling direction.

One steering plan includes may include generally vertically drilling, for a first distance, then drilling in a curve for a second distance, and then drilling generally horizontally for a third distance. To achieve this steering plan, drilling fluid pressure at an inlet to a wellbore may be increased to extend at least some of the pads when it is desirable to start curving. To stop curving when horizontal is reached, drilling fluid may be blocked from passing to the pads or the pads may be bypassed by the drilling fluid. This may be accomplished by any of a variety of devices.

Figures 1, 5:
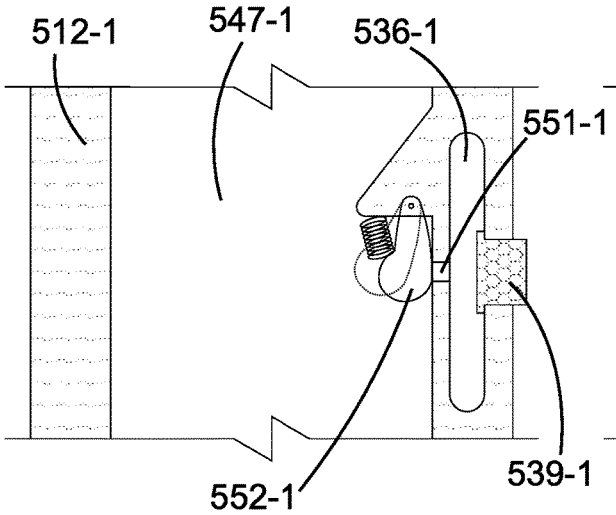
Figures 2, 5:
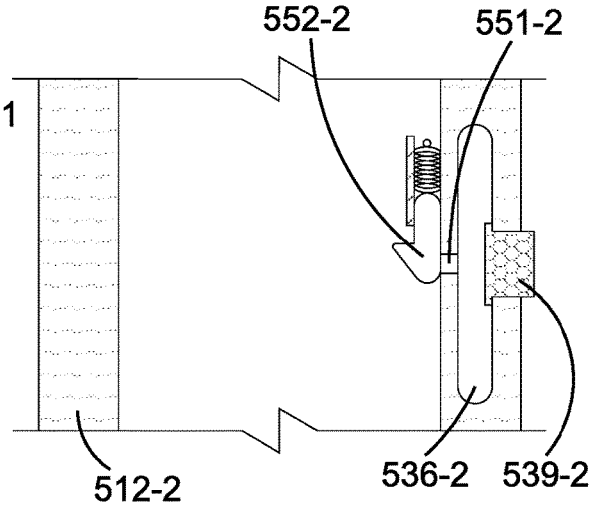
Figures 3, 5:
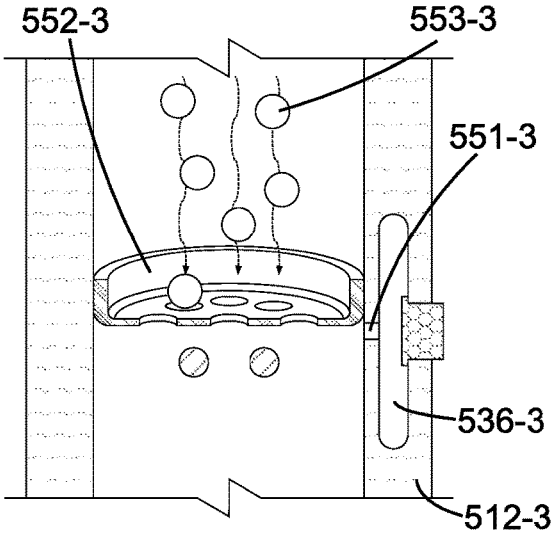
Figures 4, 5:
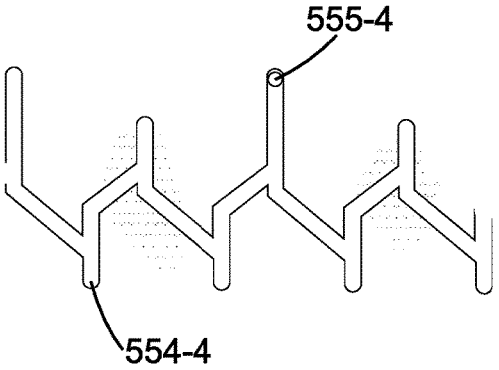
Figure 5:
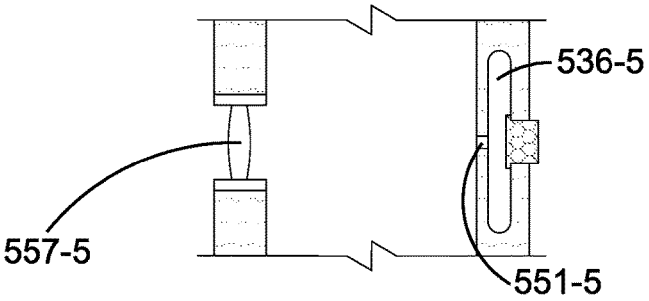

For example, drilling fluid may be blocked by shifting a mass radially within the drill string by adjusting rotation of the drill string. FIG. 5-1 shows an embodiment of a drill string 512-1 including a passage 547-1 positioned longitudinally therethrough with an opening 551-1 to a chamber 536-1. Drilling fluid traveling through the passage 547-1 may pass through the opening 551-1 into the chamber 536-1 to extend at least one extendable pad 539-1. When the drill string 512-1 is rotated at a certain speed, a mass 552-1, rotatable about a hinge, may overcome a spring by centrifugal force to block the opening 551-1 from allowing drilling fluid to pass therethrough.

Blocking drilling fluid from reaching extendable pads may also be achieved by shifting a mass longitudinally within a drill string. For example, FIG. 5-2 shows an embodiment of a mass 552-2 that may overcome a spring and shift longitudinally when a flow rate of drilling fluid passing along a drill string 512-2 is sufficient. As it does so, it may block an opening 551-2 preventing drilling fluid from entering a chamber 536-2 and extending a pad 539-2.

In other embodiments, drilling fluid may be blocked by passing one or more objects through a drill string along with the drilling fluid. For example, FIG. 5-3 shows an embodiment of a plurality of balls 553-3 that may be dropped into a drill string 512-3 and travel with drilling fluid flowing through the drill string 512-3 until they reach a slidable trap 552-3. The plurality of balls 553-3 may be sufficiently small and durable to pass through a downhole mud motor (not shown). Each of the balls 553-3 may be received within apertures formed in the slidable trap 552-3. When the apertures are obstructed by the balls 553-3, the drilling fluid may push the slidable trap 552-3 to block an opening 551-3 into a chamber 536-3.

In other embodiments, drilling fluid may be blocked by a ratcheting device. For example, FIG. 5-4 shows an embodiment of a cam slot 554-4 that may wrap around a drill string and receive a pin 555-4 that may travel therein. The cam slot 554-4 may be biased by a spring which may index the pin 555-4 relative to the cam slot 554-4 when compressed by weight-on-bit of the drill string. Indexing of the pin 555-4 to a subsequent location relative to the cam slot 554-4 may then block or unblock an opening leading to a chamber as described previously. With such a design, the opening may be blocked and unblocked repeatedly. FIGS. 15-1, 15-2, and 15-3 provide an additional example of such a ratcheting device, described below.

In yet another embodiment, drilling fluid may bypass an opening leading to a chamber. For example, in FIG. 5-5 an embodiment of a rupture disk 557-5 may be positioned adjacent an opening 551-5 to a chamber 536-5. An increase in pressure of drilling fluid passing by the rupture disk 557-5 may cause it to burst, thus causing drilling fluid to bypass outward rather than into the chamber 536-5.

Referring back to FIG. 3, while extendable pads 339 are shown, other embodiments may include different structures such as rings or stabilizer blades that may extend to produce a similar result. The pads 339 may be extendable from an exterior of the housing 333 based upon an amount of fluid pressure maintained within the chamber 336. For instance the pads 339 may extend a certain distance or with certain force based on the chamber 336 pressure. In the embodiment shown, this relationship is maintained by each pad 339 forming a piston that may slide axially along a cylinder based on a difference of pressure experienced between either end thereof. In some embodiments other configurations are possible, such as hinged pads actuated by pistons.

Additionally, a pressure gauge 305 may be disposed between the valve 337 and the pads 339. This pressure gauge 305 may provide feedback to the control mechanism 301 that may control actuation of the valve 337 to allow for a desirable fluid pressure to be achieved at the pads 339. This fluid pressure may be used to determine a distance extended or force exerted by the pads 339. Another approach may be to measure fluid pressure within the chamber.

In some embodiments, the control mechanism 301 may be configured to receive communications from the wellbore inlet to adjust the valve 337 to reach a target fluid pressure at the pads 339. For instance, a pressure wave, originating at the wellbore inlet, may be transmitted via drilling fluid along the drill string to the control mechanism 301. The pressure wave may include a signal discernible by the control mechanism 301 that may inform the control mechanism 301 of a desirable pressure for the pads 339. The control mechanism 301 may then realize that desirable pressure based on feedback from the pressure gauge 305. In some situations, the pressure wave may include instructions to the control mechanism 301 to not actuate the valve 337 at all. This override mode, where the pads 339 remain retracted, may be helpful in situations where the drill string is to be removed from a wellbore or has become stuck therein. In either case, it may be desirable to keep drilling fluid flowing through a drill string without extending the pads 339.

In the embodiment shown, the valve 337 is sized to allow between 5 and 30 gallons per minute of drilling fluid to flow therethrough. In other embodiments, this range may be between 0 and 50 gallons or more.

A method of operating the downhole steering system utilizing the valve 337 may include rotating the drill string, including the pads 339, from the wellbore inlet at one speed and the drill bit 311 via the motor at a different speed. A trajectory of the drill bit 311 may be altered by repeatedly extending the pads 339 as the drill string continues to turn. Such repeated extensions may be timed to carry out a set well plan or return the drill bit 311 to its intended trajectory if it begins to stray. Specifically, as a drill string rotates, the pads 339 may rotate therewith. As the pads 339 pass through an angular range of the drill string circumference, facing generally opposite a lateral direction in which it is desirable to steer, the pads 339 may be extended by actuating the valve 337 to push off of a wellbore wall. As the pads 339 exit that angular range, they may be retracted to disengage from the wellbore wall.

In some embodiments, the pads 339 may be extended without any communication from the inlet. For example, the control mechanism 301 controlling the valve 337 may include one or more sensors configured to sense direction, inclination, angular position, rotation and/or lateral displacement of the drill bit 311. As another example, the control mechanism 301 may include one or more sensors configured to measure a property of a formation surrounding the housing 333. Actuation of the valve 337 may be based on the direction, inclination, angular position, rotation and/or lateral displacement sensed or the formation property measured. To avoid destabilizing drilling behaviors that may be caused by repetitive cyclical pad extensions, it may be desirable for these repeating pad extensions to occur for a brief moment every several rotations or for a full rotation every several rotations.

One method of operating the downhole steering system utilizing this downhole rotation sensor may be to rotate the drill string or hold it rotationally stationary at the inlet, sense this rotation or lack thereof downhole and then actuate the valve 337 and extend or retract the pads 339 based thereon. By so doing, the control mechanism 301 might not be configured to communicate axially beyond the first and second bearings 334, 335. Torque from the rotor shaft 330 of the motor may be passed through the shaft 332 to rotate the drill bit 311. This rotation of the drill bit 311 via the motor may allow the drill bit 311 to continue its advance regardless of whether it is being rotated from the inlet. Extending or retracting the pads 339 may include holding the valve 337 in one state, either open or closed, while the drill string is rotating and in an opposite state while the drill string is rotationally stationary. In some situations, a specified rate of change of drill bit trajectory may be achieved by alternating between rotating the drill string at the inlet and holding it rotationally stationary in particular amounts. More specifically, to produce a certain rate of change of trajectory, a specific ratio of time may be spent rotating versus holding rotationally stationary.

A defined drill plan may be followed. For example, the drill string may be rotated at the inlet to drill substantially straight in a generally vertical direction for a first distance. The drill string may then be held rotationally stationary at the inlet to drill at a curve for a second distance. Finally, the drill string may be rotated again at the inlet to drill substantially straight again, this time generally horizontally, for a third distance.

In some embodiments, the closer extendable pads are placed to a downhole drill bit, the more effect they may have on a trajectory of the drill bit. For instance, in the present embodiment, the pads 339 may be positioned axially along the housing 333 a distance from a distal end of the drill bit 311 equal to or less than two times a diameter of the drill bit 311. Unlike prior attempts to place extendable structures as close as possible to their respective drill bits, however, the structure shown need not bypass either of the first or second bearings 334, 335.

To get the pads 339 as close as possible to the drill bit 311, a pin and box combination may be used. In some configurations, a drill string generally includes a threaded box into which a threaded pin of a drill bit may be fastened to secure the drill bit to the drill string in a manner configured to transfer rotation therebetween. In the present embodiment, however, the shaft 332 includes a pin 302 that may be received and fastened within a box 303 of the drill bit 311. This configuration may position the pads 339 even closer to the drill bit 311 than the other configuration, where the threaded pin of the drill bit is secured to the box of the drill string.

Another component that may have a similar effect to positioning the pads 339 as close as possible to the drill bit 311 is to locate one or more cutting elements 304 on the shaft 332 itself adjacent to the drill bit 311 as shown.

In some embodiments, it may be desirable to pass at least some drilling fluid to a chamber and pads regardless of whether a valve is actuated or not. Also, in some situations, such a valve may be or include a proportional valve configured to proportionally control of fluid pressure within a chamber.

A variety of different bearing designs may be used in conjunction with a downhole steering system of the type described. One variety of bearings may allow drilling fluid flowing along a drill string to pass through the bearings themselves to lubricate the bearings as well as control fluid pressure within the chamber. For example, the first bearing 334 may include an internal journal and an external housing, with the internal journal and the external housing being movable with respect to one another. A gap between the journal and the housing may allow drilling fluid to pass by. In various embodiments, the gap may be sized to allow sufficient drilling fluid to pass to pressurize the chamber 336 while blocking larger particulate matter from entering the chamber 336. The second bearing 335 may also allow some drilling fluid to pass through a gap therein sufficient to lubricate the second bearing 335 while not overly reducing fluid pressure within the chamber 336. In this manner, the second bearing 335 may maintain a greater pressure differential thereacross than across the first bearing 334. Such dissimilarity in pressure differentials may aid in maintaining a desired pressure within the chamber 336.

Figures 1, 6:
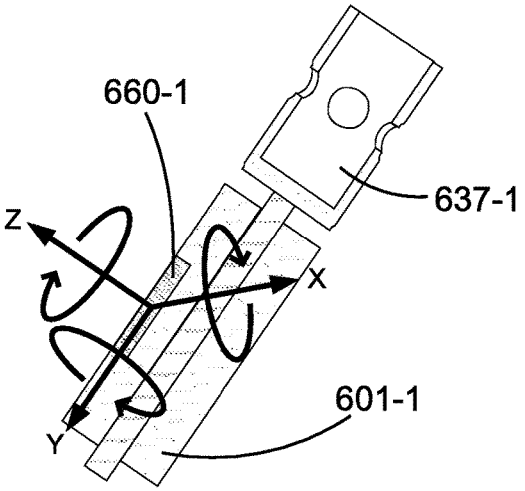
Figures 2, 6:
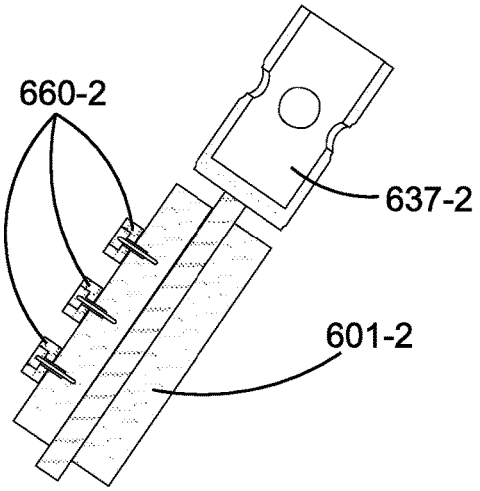
Figures 3, 6:
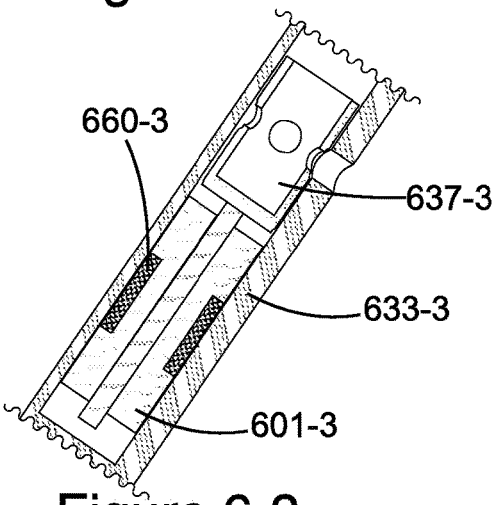
Figures 4, 6:
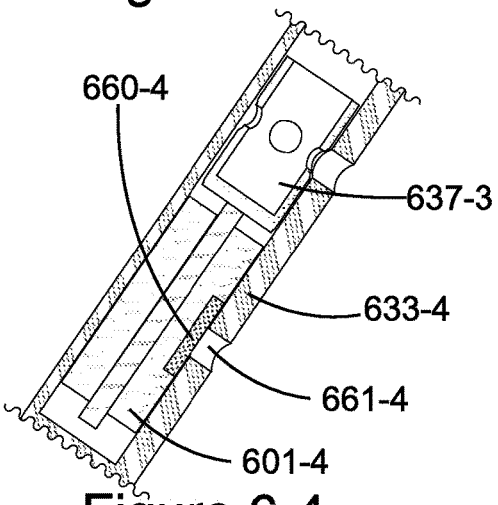
Figures 5, 6:
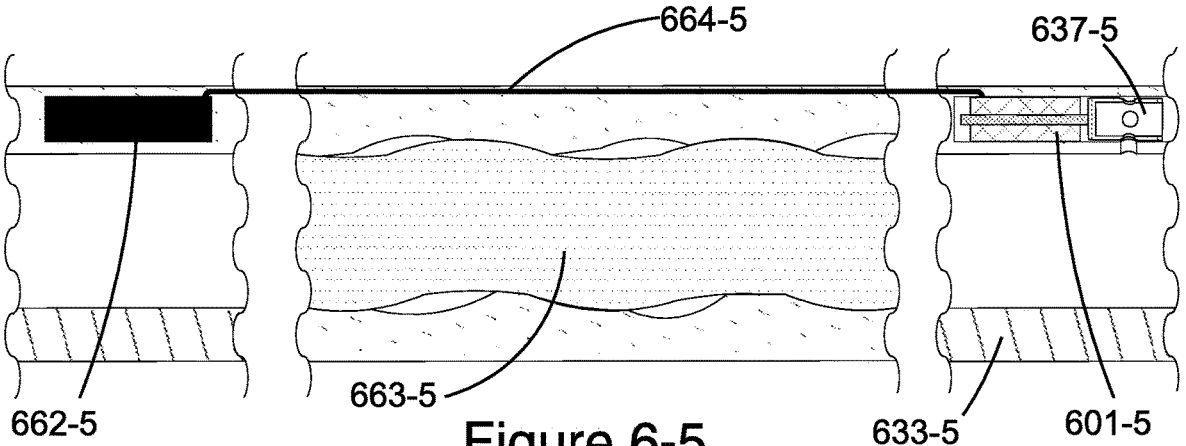

FIG. 6-1 shows an embodiment of a control mechanism 601-1 configured to actuate a valve 637-1. The control mechanism 601-1 includes a sensor 660-1 configured to measure direction and inclination of the control mechanism 601-1 via a three-axis accelerometer that may measure accelerations in x, y and z directions, respectively. While a three-axis accelerometer is illustrated, those of skill in the art will recognize that a variety of other sensor types could additionally or alternately be used. Further, in some embodiments, other characteristics of a substantially tubular housing, such as angular position or rotation, may be measured by such a sensor device. Other embodiments may measure a lateral displacement of a substantially tubular housing relative to a wellbore. Such measurements may be made by a caliper-like sensor or by a determination of pad stroke length. In various embodiments, such a control mechanism may be powered by batteries or a generator configured to convert energy from a flowing drilling fluid to electricity to energize a valve and/or sensor.

FIG. 6-2 shows another embodiment of a control mechanism 601-2 configured to actuate a valve 637-2. This control mechanism 601-2 includes a series of sensors 660-2 configured to measure a property of a formation proximate the sensors 660-2. In this embodiment, the sensors 660-2 are configured to measure electrical resistivity of an adjacent formation. This may be accomplished by injecting current into the formation via a first electrode, surrounded by an insulating ring, of one of the sensors 660-2 and receiving current from the formation via a second electrode of another of the sensors 660-2. While resistivity sensors are featured in the embodiment shown, those of skill in the art will recognize that a variety of other sensor types could alternately be used to measure any of a variety of formation properties.

FIG. 6-3 shows an embodiment of a control mechanism 601-3 housed within a sidewall of a portion of a substantially tubular housing 633-3. The control mechanism 601-3 includes an acoustic receiver 660-3 configured to detect acoustic waves propagating through the housing 633-3. Specifically, the acoustic receiver 660-3 may include a plurality of piezoelectric crystals positioned such that they contact the housing 633-3. Acoustic waves propagating through the housing 633-3 may apply mechanical stress to the piezoelectric crystals causing an electric charge to accumulate therein. These acoustic waves may carry information or directions to the control mechanism to guide it in its actuation of a valve 637-3 and be sent from another downhole tool or from a surface of a wellbore. While piezoelectric crystals have been shown in this embodiment, those of skill in the art will recognize that a selection of other sensor types may alternately be used and produce similar results.

FIG. 6-4 shows another embodiment of a control mechanism 601-4 housed within a sidewall of a portion of a substantially tubular housing 633-4. The control mechanism 601-4 includes a pressure sensor 660-4 configured to measure pressure waves propagating through a fluid flowing through the housing 633-4. Such pressure waves may originate from a wellbore inlet or a downhole device, such as a measurement-while-drilling unit disposed axially beyond first or second bearings, and/or a mud motor, from a control mechanism. Pressure waves generated by a measurement-while-drilling unit and intended for a wellbore inlet may be received and comprehended by a control mechanism as described. In some embodiments, actuation of a valve of the sort shown may create pressure waves in fluid that may be discernible at a wellbore inlet or another downhole device, allowing for two-way communication.

As shown, the control mechanism 601-4 includes a piezoelectric crystal facing an opening 661-4 in the housing 633-4. This opening 661-4 may expose the piezoelectric crystal to fluid flowing through the housing 633-4. Changes in pressure of that fluid may apply mechanical stress to the piezoelectric crystals causing an electric charge to accumulate therein as described in regards to other embodiments. While piezoelectric crystals have been shown in this embodiment, those of skill in the art will recognize that a selection of other sensor types may alternately be used and produce similar results.

FIG. 6-5 shows yet another embodiment of a control mechanism 601-5 housed within a sidewall of a substantially tubular housing 633-5. In this embodiment, a downhole device 662-5, such as a measurement-while-drilling unit, may be disposed on an opposite side of a mud motor 663-5 from the control mechanism 601-5. The downhole device 662-5 may comprise its own detection and measurement equipment, separate from any sensors forming part of the control mechanism 601-5. Such detection and measurement equipment, of the downhole device 662-5, may be larger and more sophisticated due to it being positioned axially farther from a drill bit than the control mechanism 601-5. Thus, more detailed and complex information may be gathered by the downhole device 662-5. The downhole device 662-5 may transmit at least some of this data to the control mechanism 601-5. In the embodiment shown, this data is transmitted to the control mechanism 601-5 via a communications wire 664-5 that may bypass the mud motor 663-5 through a sidewall thereof. The control mechanism 601-5 may actuate a valve 637-2 based on this transmitted information. In other embodiments, a measurement-while-drilling unit, or other downhole device, may transmit data past a mud motor to a valve control mechanism via acoustic waves propagating through a housing or pressure waves propagating through a fluid.

Figures 1, 7:
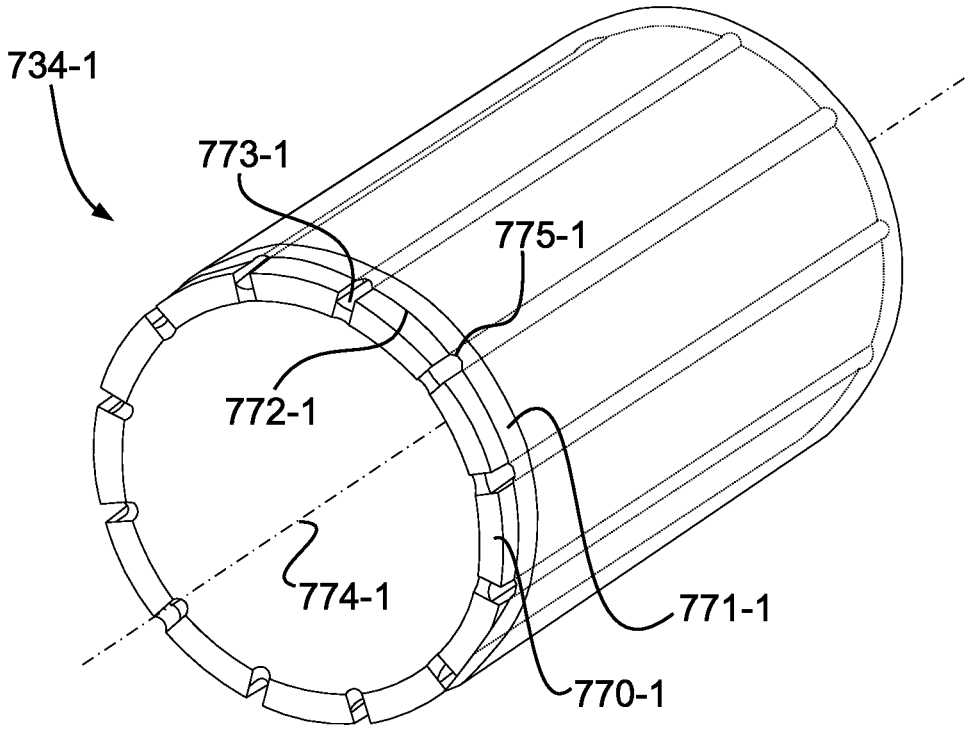
Figures 2, 7:
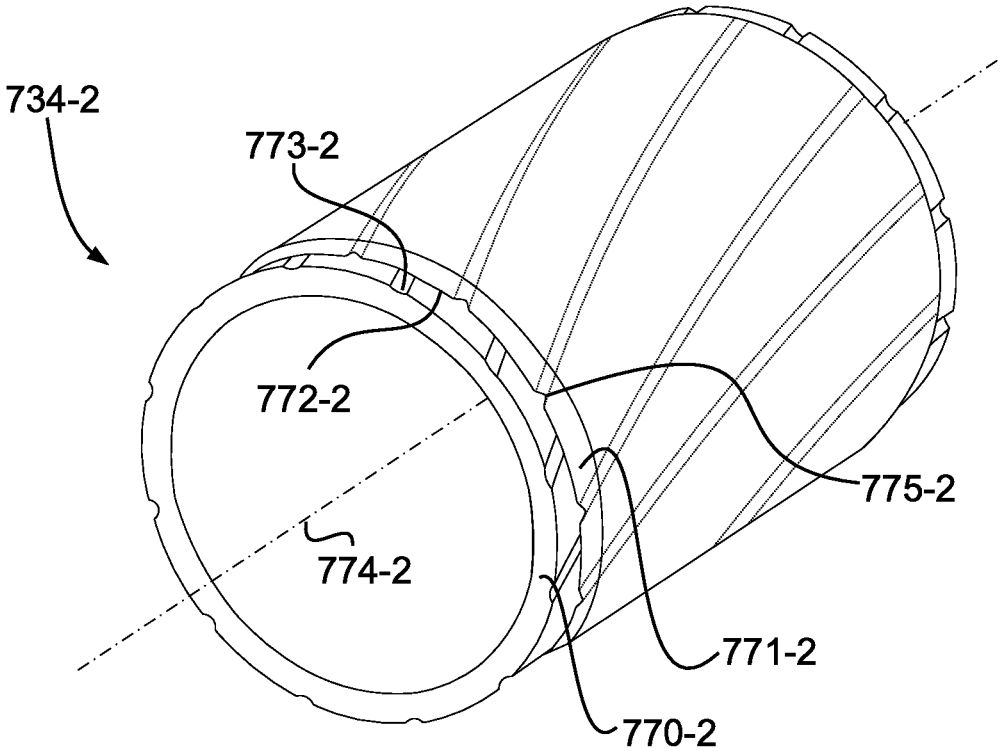
Figures 3, 7:
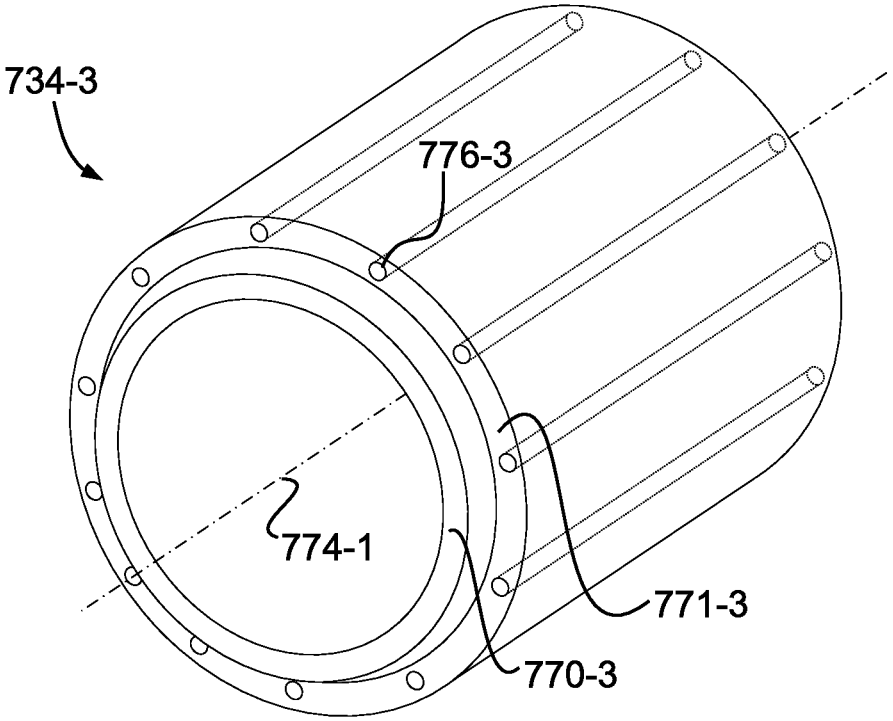

FIGS. 7-1 and 7-2 show embodiments of bearings 734-1 and 734-2, respectively, including journals 770-1, 770-2 that are movable with respect to housings 771-1, 771-2. The bearings 734-1, 734-2 include fluid passages, such as clearances 772-1, 772-2 formed between the journals 770-1, 770-2 and housings 771-1, 771-2 that may allow drilling fluid to flow therebetween while restricting larger particulates. Tolerances in the clearances 772-1, 772-2 provided to maintain concentricity of the journals 770-1, 770-2 and housings 771-1, 771-2, may impede the ability to establish and maintain sufficient fluid pressure within a chamber. Accordingly, the bearing 734-1, 734-2 may define flow passage geometries through which additional drilling fluid may pass.

FIG. 7-1 shows a geometry including a plurality of grooves 773-1 disposed on an exterior of the journal 770-1 sitting parallel to a rotational axis 774-1 thereof. Another plurality of grooves 775-1 may be disposed on an interior of the housing 771-1. The combination of grooves 773-1, 775-1 may include a total cross-sectional area sufficient to allow up to 30 gallons per minute or 5% of a total flow of drilling fluid flowing through a drill string to pass the bearing 734-1. In other embodiments, this area may allow up to 60 gallons per minute, or 10% of a total, or more to pass.

FIG. 7-2 shows another geometry including a plurality of grooves 773-2 disposed on an exterior of the journal 770-2 and another plurality of grooves 775-2 disposed on an interior of the housing 771-2. Each of these grooves 773-2, 775-2 may curve around a rotational axis 774-2 of the bearing 734-2 to form a helical path. Such curved grooves 773-2, 775-2 may aid in cleaning the exterior of the journal 770-2 and the interior of the housing 771-2.

FIG. 7-3 shows an embodiment of a bearing 734-3 including a journal 770-3 rotatable within a housing 771-3. The housing 771-3 includes a plurality of conduits 776-3 extending along a length thereof and allowing a drilling fluid to flow therethrough. In other embodiments, conduits may be disposed within a journal as well or forming helical paths.

Figures 1, 8:
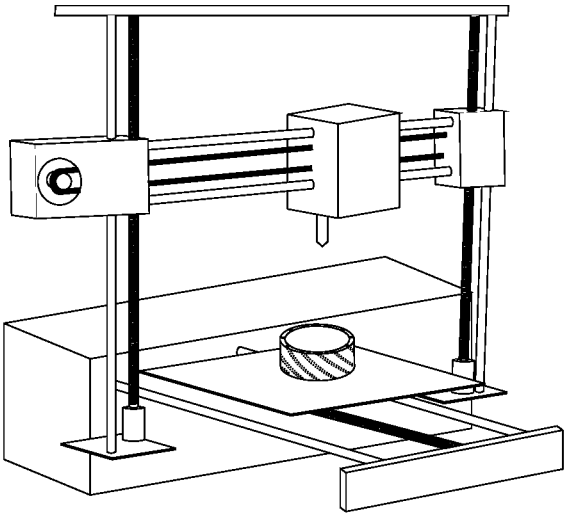
Figures 2, 8:
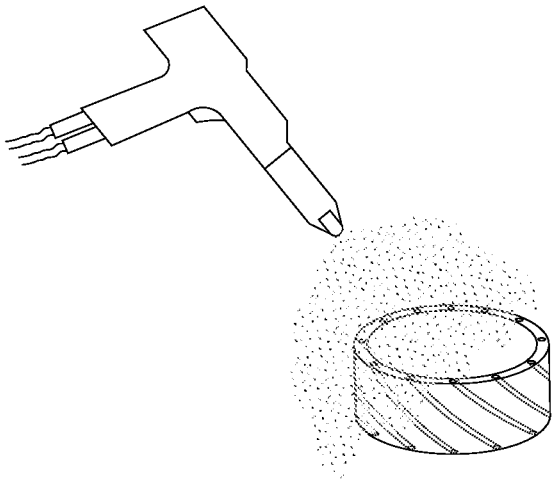

Various manufacturing methods may be used to create bearings including such intricate geometries. Specifically, it may not be possible to form a nonlinear conduit using a drill. Thus, for example, one manufacturing technique that has been used is three-dimensionally printing a base structure having the desired geometry as shown in FIG. 8-1. As commonly available three-dimensionally printable materials are not generally suited to withstand abrasive conditions, the three-dimensionally printed base may be coated in materials chosen to withstand abrasion as shown in FIG. 8-2.

Figures 1, 9:
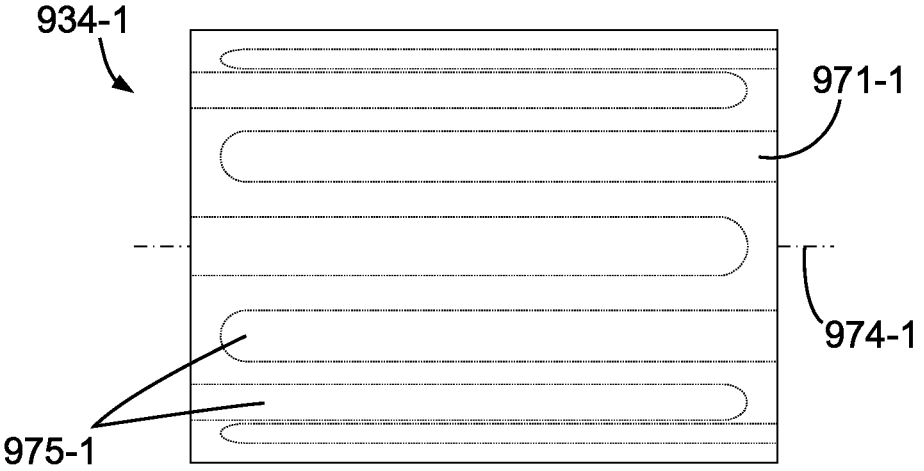
Figures 2, 9:
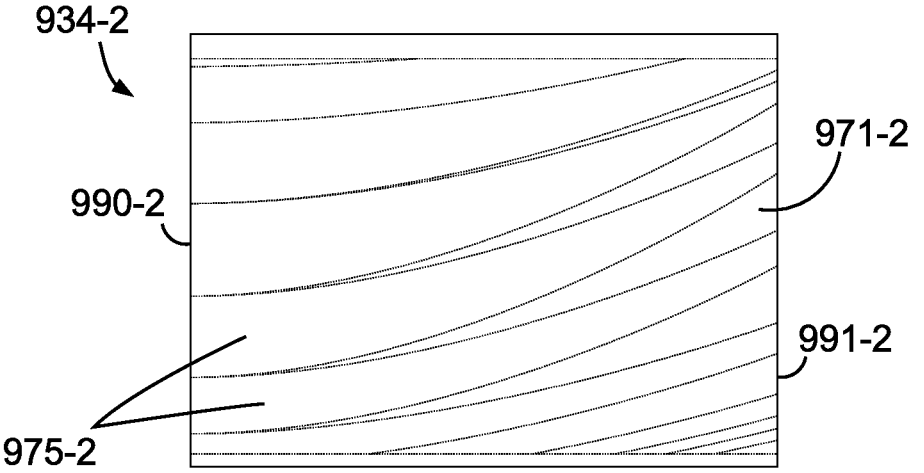
Figures 3, 9:
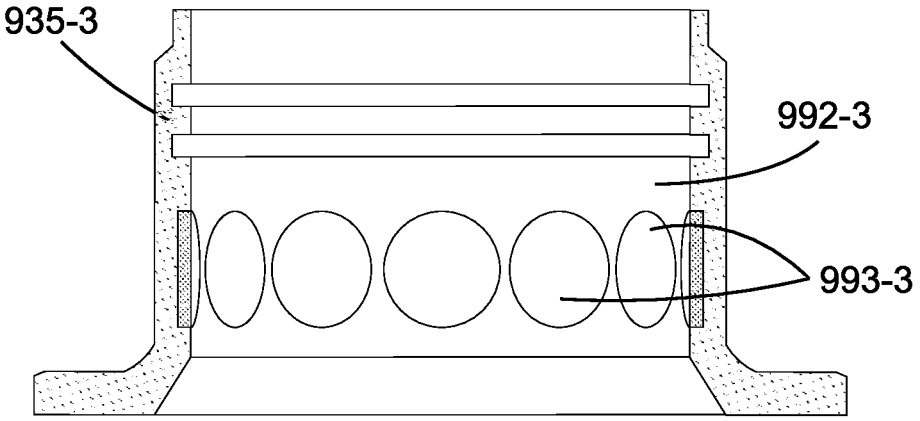

FIG. 9-1 shows an embodiment of a bearing 934-1 including a plurality of grooves 975-1 disposed on an interior of a housing 971-1 and sitting parallel to a rotational axis 974-1 thereof. As can be seen, each of the grooves 975-1 may extend only part way along an axial length of the bearing 934-1. Additionally, each of the grooves 975-1 may extend from opposing ends alternatingly. Grooves of this and similar geometries may increase an area for fluid flow between a journal and housing. Such grooves may also allow for cleaning and lubrication while blocking large particulate.

FIG. 9-2 shows another embodiment of a bearing 934-2 including a plurality of grooves 975-2 disposed on an interior of a housing 971-2. In this embodiment, the grooves 975-2 are cross-sectionally larger on a first end 990-2 than on an opposing second end 991-2. Positioning the second end 991-2 facing toward a chamber and second bearing may allow the bearing 934-2 to act like a compressor in that large amounts of drilling fluid may enter the grooves 975-2 at the first end 990-2 and then be forced into a smaller space at the second end 991-2 as the housing 971-2 rotates relative to a journal. By so doing, a fluid pressure within the chamber may be greater than before entering through the bearing 934-2. Additionally, the fluid pressure within the chamber may be dependent and at least somewhat regulated by a rotational speed of the housing 971-2 relative to the journal.

FIG. 9-3 shows another embodiment of a bearing 935-3 including discrete superhard elements 993-3 (e.g., polycrystalline diamond, cubic boron nitride, carbon nitride or boron-nitrogen-carbon structures) secured within cavities on an internal surface 992-3 thereof. The internal surface 992-1 may include hard cladding (e.g., tungsten and tungsten carbide) brazed thereto. Such features may prolong the life of these types of bearings.

Figures 1, 10:
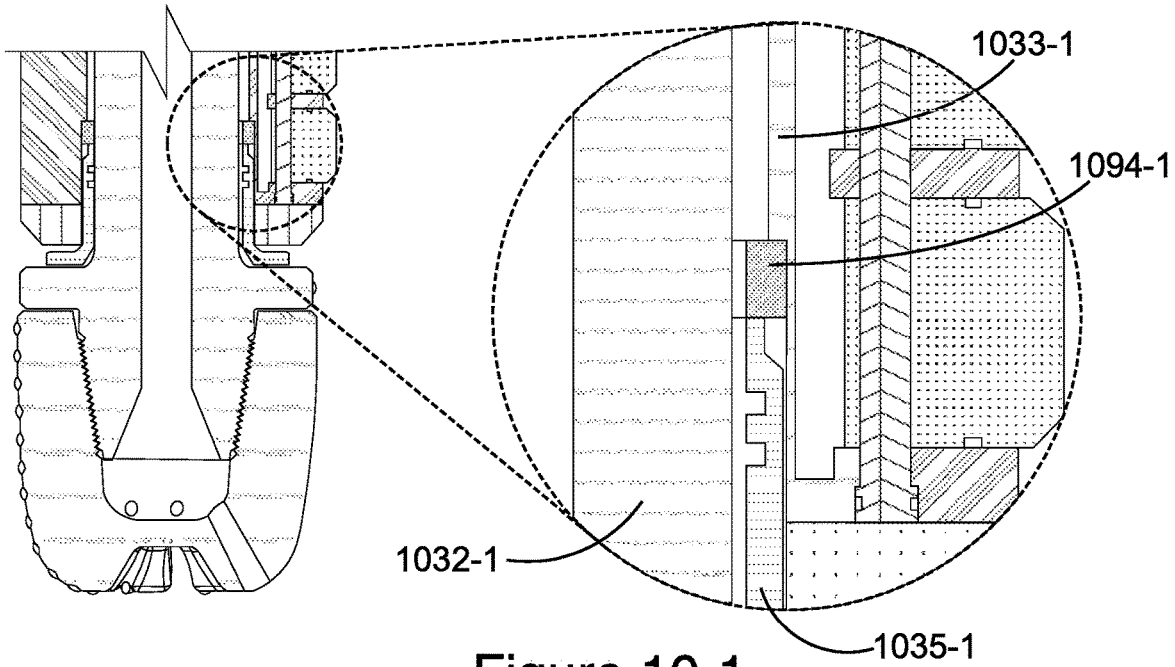
Figures 2, 10:
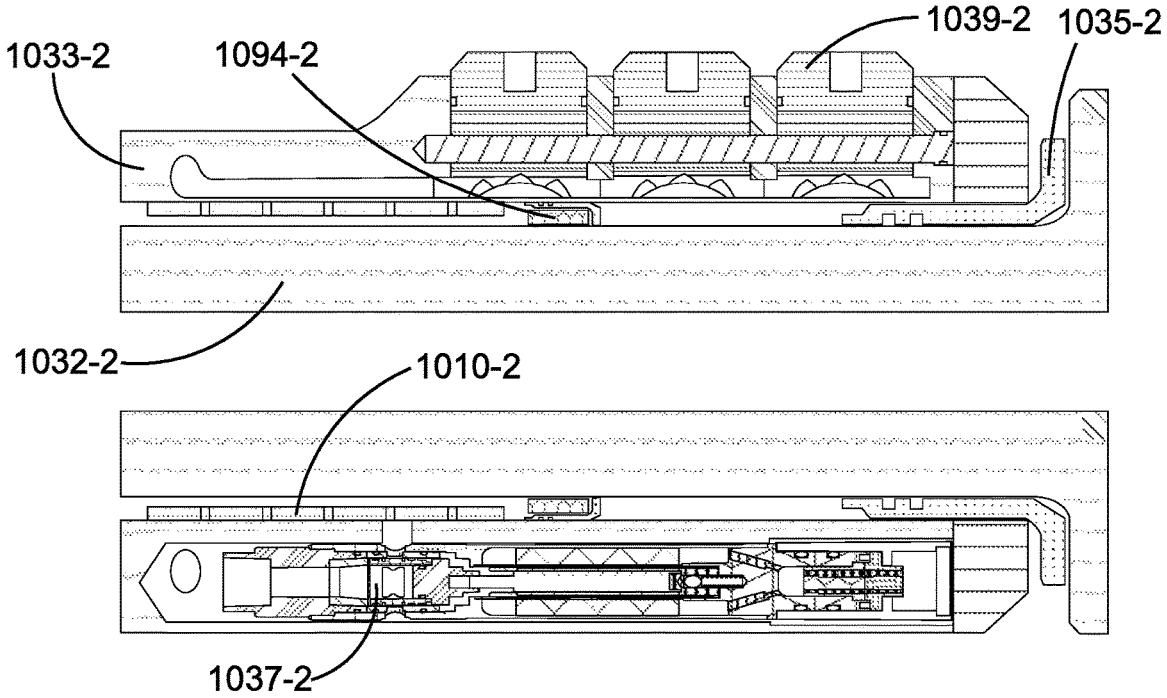

FIG. 10-1 shows an embodiment of a ring 1094-1 that may be disposed between a shaft 1032-1 and a substantially tubular housing 1033-1. The ring 1094-1 rests axially between a second bearing 1035-1 and an internal ledge formed in the housing 1033-1, although other configurations are possible. This ring 1094-1 may allow the second bearing 1035-1 and an axially spaced first bearing (not shown) to support the shaft 1032-1 axially relative to the housing 1033-1 as well as radially.

FIG. 10-2 shows an embodiment of another type of ring, this time forming a flow restrictor 1094-2. The ring forming this flow restrictor 1094-2 may be retained axially, but otherwise float freely between a shaft 1032-2 and a housing 1033-2. In this configuration, the flow restrictor 1094-2 may impede fluid flow passing between the shaft 1032-2 and the housing 1033-2. Restricting or impeding this fluid flow may reduce wear on a second bearing 1035-2 that also interacts with the flow.

FIG. 10-2 also shows an embodiment of a filter 1010-2 that may screen particulate matter of a given size traveling with the fluid flow from reaching a valve 1037-2 or extentable pads 1039-2 there beyond. Thus, this filter 1010-2 may reduce wear on the valve 1037-2, pads 1039-2 and internal fluid channels.

Figure 11:
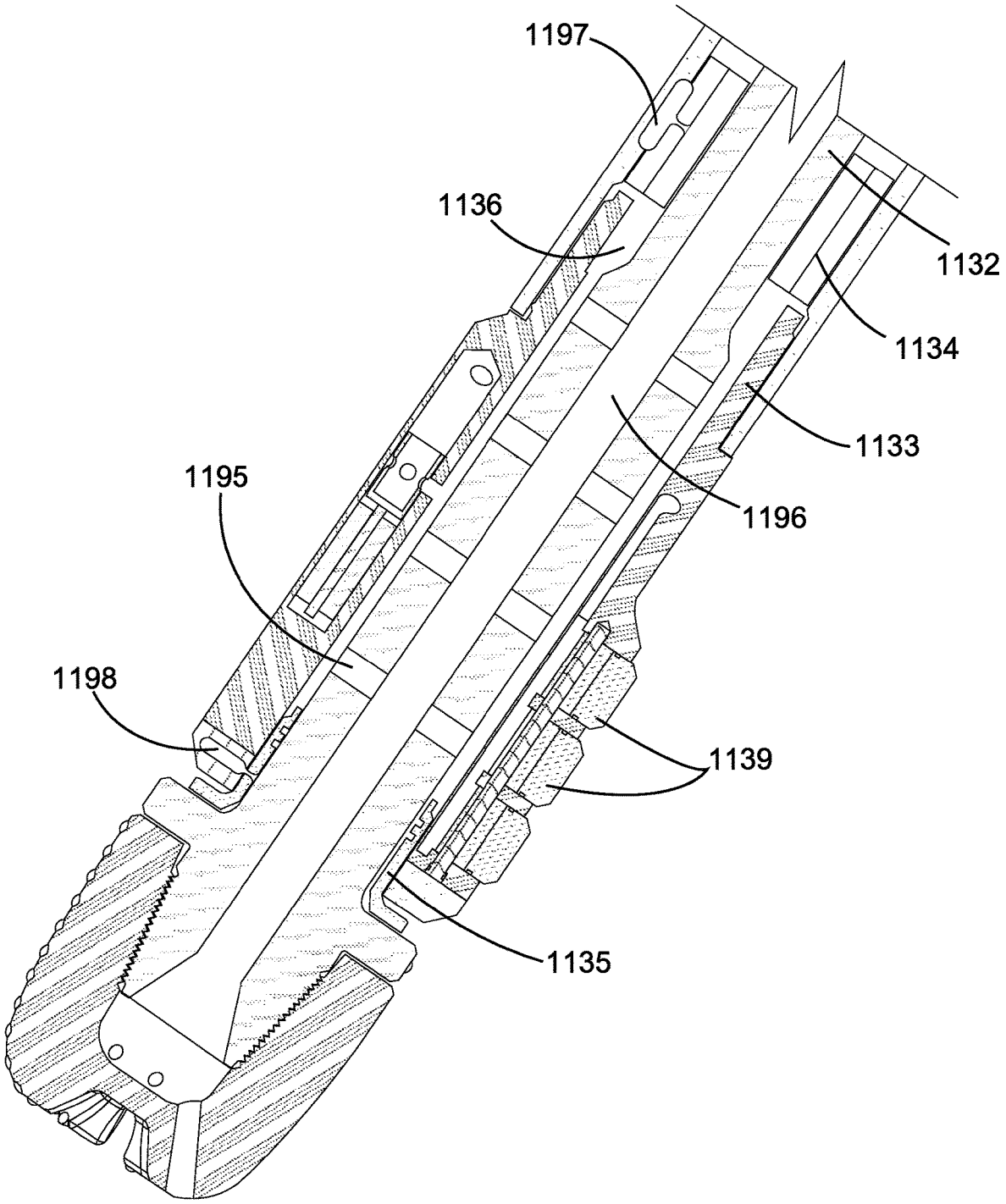
FIG. 11 is a longitude-sectional view of an embodiment of oil lubricated bearings.

Bearing designs described thus far have generally been lubricated by drilling fluid passing through the bearing. However, other lubrication methods are also possible. For example, FIG. 11 shows an embodiment of a chamber 1136 defined by a shaft 1132, a substantially tubular housing 1133, and first and second bearings 1134, 1135. The chamber 1136 may be filled and pressurized by at least one port 1195 passing from a hollow interior 1196 of the shaft 1132, through which drilling fluid may be flowing, to the chamber 1136. The first and second bearings 1134, 1135 may be lubricated by oil released from first and second reservoirs 1197, 1198, respectively. While not specifically shown, various embodiments of ports may include screens or filters to keep larger particulate matter traveling down a hollow interior of a shaft from entering a pressure chamber. Further, similar to bearing designs described previously, pressurized drilling fluid may be channeled from the chamber 1136 to a plurality of extendable pads 1139 without needing to bypass either of the first or second bearings 1134, 1135.

Figure 12:
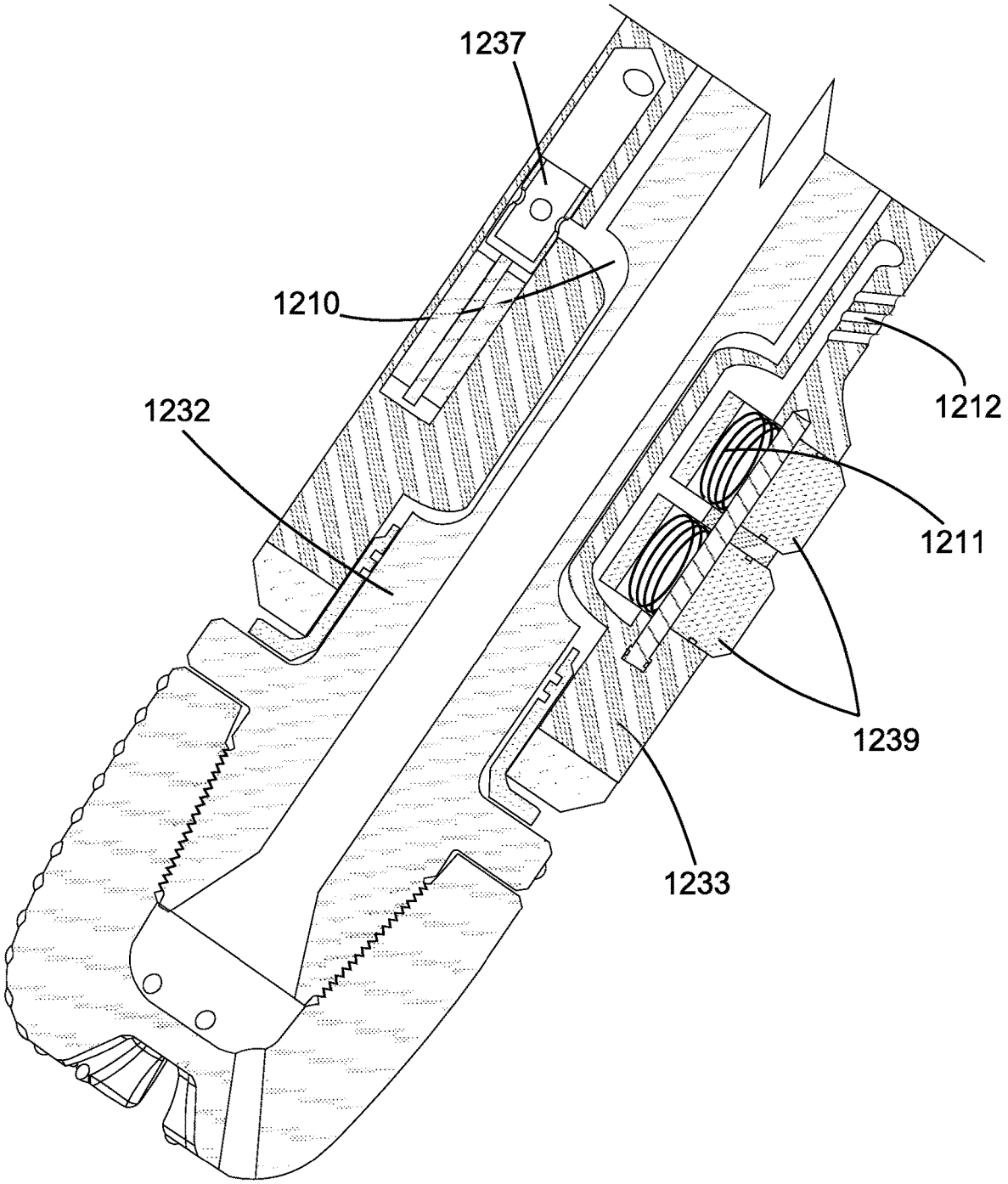
FIG. 12 is a longitude-sectional view of an embodiment of a shaft including a cavity therein sized to receive proximal ends of extendable pads.

FIG. 12 shows an embodiment of a shaft 1232 positioned within a substantially tubular housing 1233. The shaft 1232 may include a cavity 1210 disposed on an external surface thereof. The cavity 1210 may surround the shaft 1232 and be sufficiently sized to allow proximal ends of a plurality of extendable pads 1239 to fit therein. Allowing the pads 1239 to retract into the cavity 1210 may provide for a longer pad stroke in general, thus increasing how far they may extend from an exterior of the housing 1233.

Moreover, the embodiment shown includes a plurality of elastic members 1211, such as springs, each individually urging one of the pads 1239 to retract into the cavity 1210. These elastic members 1211 may allow for active retraction of the pads 1239 rather than relying completely on pressure from outside the housing 1233.

Retraction of the pads 1239 requires removing some fluid from within the cavity 1210. Without removing fluid, rather than retracting, the pads 1239 would generally hydraulically lock when a valve 1237 leading to the cavity 1210 was shut. In some embodiments, hydraulic locking of pads may be avoided by allowing some fluid to leak past the pads to exhaust from a cavity. In this embodiment, however, exhausting may be amplified by at least one port 1212 passing from the cavity 1210 to an exterior of the housing 1233. This port 1212 may be sized relative to the valve 1237 such as to have a minor effect on fluid pressure within the cavity 1210 when the valve 1237 is open but allow pressure within the cavity 1210 to decrease when the valve 1237 is closed. Pressure within the cavity 1210 may decrease to a point where it is overcome by pressure outside of the housing 1233 which may cause the pads 1239 to retract.

So far, embodiments of pads pressurized by drilling fluid have primarily been discussed. Additional embodiments of downhole steering systems, however, may include pads extendable by a variety of alternate means. For example, in some embodiments, pressurized hydraulic fluid, such as oil, may be channeled within a closed circuit from a reservoir to a plurality of extendable pads. Such hydraulic fluid may pass through a valve to a chamber positioned adjacent the pads to urge them outward from a substantially tubular housing. In some embodiments, an electrical screw may be used to extend pads from such a housing. For instance, in some embodiments, a control mechanism may rotate a nut engaged with a screw such that the screw translates axially with respect to the nut. As the screw translates it may urge at least one pad outward from the housing. Those of skill in the art will recognize that an assortment of additional devices could be interchanged with those described herein and function in a similar manner.

Figure 13:
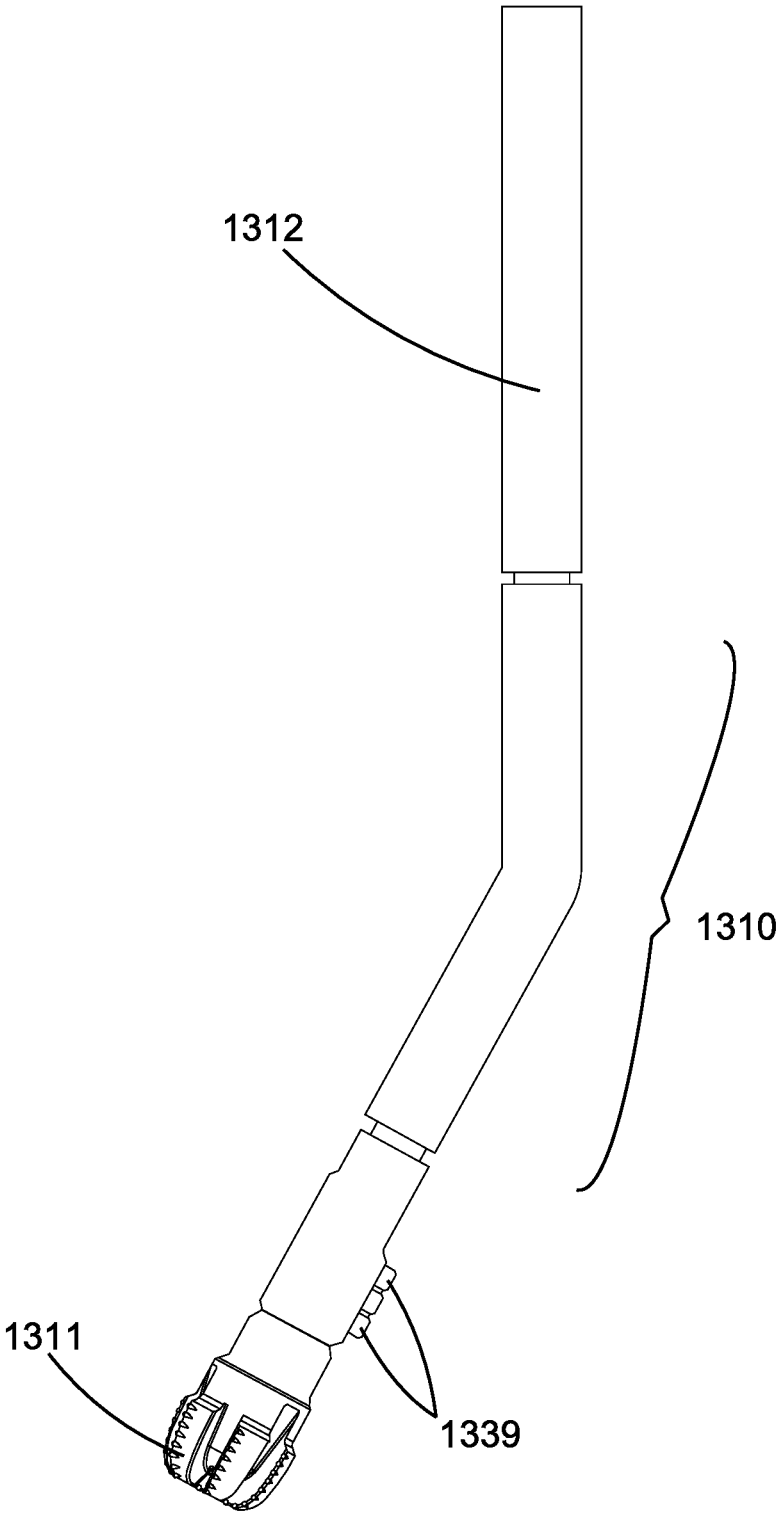
FIG. 13 is an orthogonal view of an embodiment of a downhole steering system including a combination of both extendable pads and a bent sub.

FIG. 13 shows an embodiment of a downhole steering system including a plurality of pads 1339 extendable from an exterior thereof that may push off a wall of a wellbore to aid in steering a drill bit 1311. In combination with the extendable pads 1339, the steering system may also include a bent sub 1310 portion of a drill string 1312. In this configuration, force applied by the pads 1339 against a wall of a wellbore may either add to or take away from the already bent section of the drill string 1312 allowing for greater severity when altering trajectory of advancement of the drill bit 1311.

Figure 14:
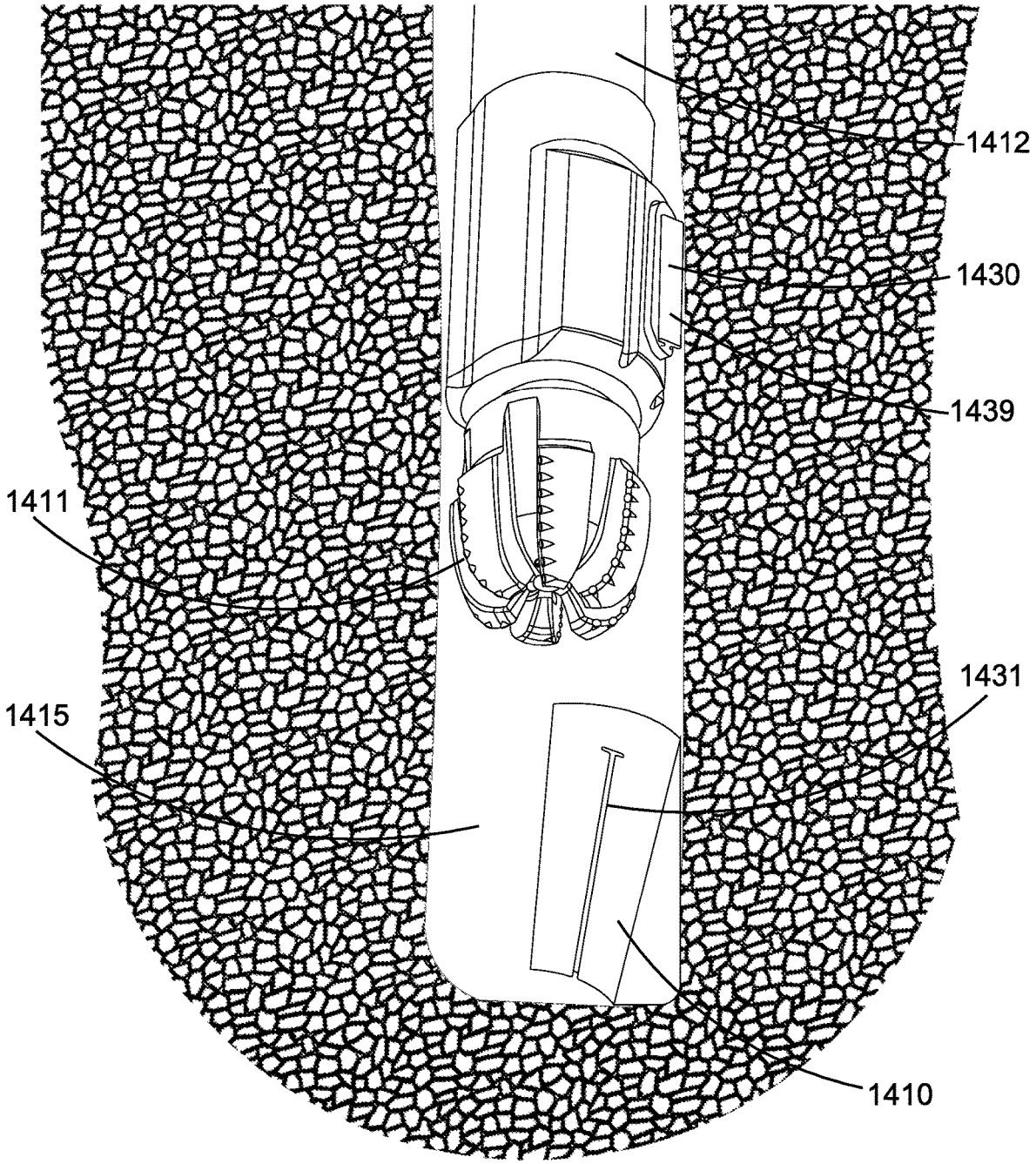
FIG. 14 is a perspective view of an embodiment of a downhole steering system including a combination of both extendable pads and a mating whipstock.

FIG. 14 shows an embodiment of a whipstock 1410 which is a device, often shaped generally as a ramp, which may be disposed in a wellbore 1415 to alter a trajectory of a drill bit 1411 as it drills. In use, when engaged by the drill bit 1411, the whipstock 1410 may push the drill bit 1411 sideways, off its current trajectory. In the present embodiment, a pad 1439, extendable from an exterior of a drill string 1412 secured to the drill bit 1411, may include a geometry 1430 configured to be slidably received within a mating geometry 1431 of the whipstock 1410. In this configuration, the geometry 1430 of the pad 1439 may align with the geometry 1431 of the whipstock 1410 when in proximity thereto to combine the force exerted by extension of the pads 1439 with push of the whipstock 1410 for greater severity when altering trajectory of advancement of the drill bit 1411.

FIGS. 15-1, 15-2, and 15-3 illustrate another embodiment of a ratcheting device 1500, similar to the embodiment described above with reference to FIG. 5-4. As shown, the ratcheting device 1500 may include a valve element 1502 and a valve housing 1504. The valve element 1502 may be positioned in the valve housing 1504 and may define an indexing slot 1506. The indexing slot 1506 may be similar in shape to the slot 554-5 (FIG. 5-4), and may extend partially or entirely around the circumference of the valve element 562. The valve element 1502 may further include one or more fingers 1507. Ports 1509 may be defined between the fingers 1507.

The ratcheting device 1500 may also include a biasing member 1508, such as a spring that is coiled around or within the valve element 1502 (or both, as shown). The biasing member 1508 may be configured to bear against the valve housing 1504, either directly or via connection with another member, and the valve element 1502, so as to push the valve element 1502 in an axial direction (e.g., to the right, as shown) with respect to the valve housing 1504.

The ratcheting device 1500 may further include an indexing pin 1510, which may extend inwards from the valve housing 1504, and may be received into the indexing slot 1506. When the valve element 1502 moves with respect to the valve housing 1504, the indexing pin 1510 advances in the indexing slot 1506, and translates some of the axial motion of the valve element 1502 into rotational movement thereof.

The housing 1504 may define openings 1520 therein and an inlet opening 1521. Drilling fluid pressure acts on the valve element 1502 through the inlet opening 1521. When the ratcheting device (valve) 1500 is in an open position, the ports 1509 of the valve element 1502 may be aligned with the openings 1520, allowing fluid communication through the ratcheting device 1500. When the ratcheting device 1500 is in a closed position, whether caused by the fingers 1507 being rotationally aligned with and thereby blocking the openings 1520 or the valve element 1502 being pushed axially toward the right, such that the ports 1509 are axially misaligned from the openings 1520, fluid is prevented from proceeding through the openings 1520.

Figures 1, 15:
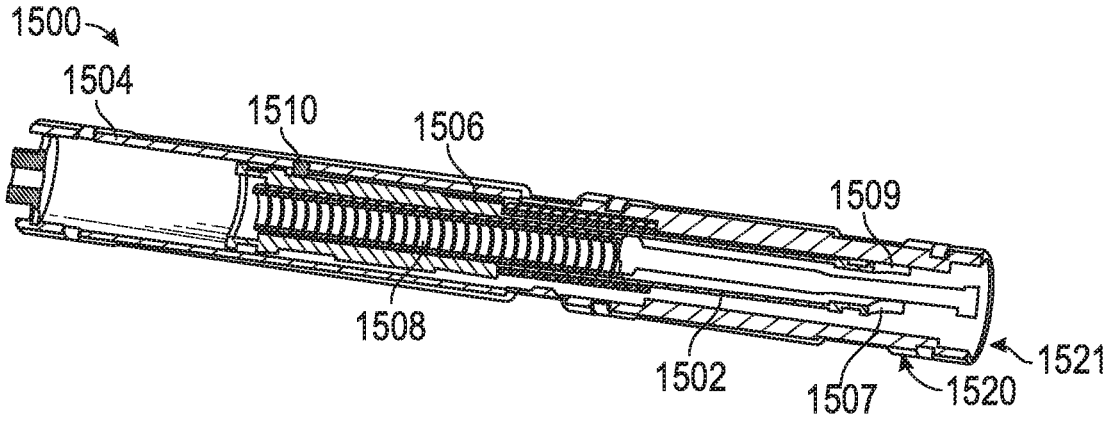
Figures 2, 15:
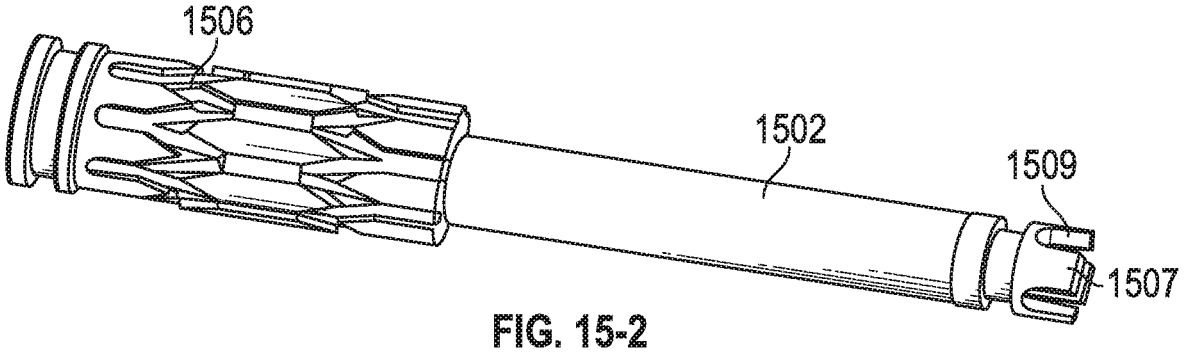
Figures 3, 15:
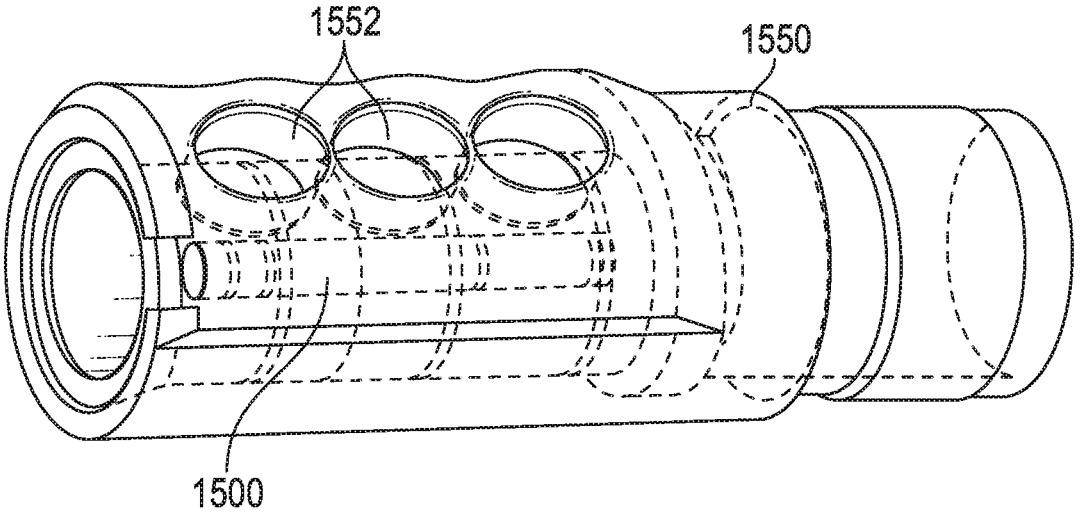

Referring now specifically to FIG. 15-3, but with continuing reference to FIGS. 15-1 and 15-2, there is shown an embodiment of the ratcheting device 1500 positioned in a housing 1550. Similar to the embodiment described above, radially extendable structures (e.g., pistons) 1552 may be positioned on or in the exterior of the housing 1550. The structures 1552 may be extendable in response to and propelled outwards by pressure selectively communicated thereto from the interior of the housing 1550.

In order to control the communication of such pressure, the ratcheting device 1500 is provided. Drilling fluid pressure acts on the valve element 1502 via the inlet opening 1521, pushing the valve element 1502 (e.g., to the left in FIG. 15-2) in the housing 1504. The axial motion of the valve element 1502, as it overcomes the biasing member 1508, is partially converted to rotational movement by the interaction between the slot 1506 and the pin 1510, thereby causing the ports 1509 to align with the openings 1520. Thus, fluid pressure communicates to the structures 1552, which extend outwards. When the pressure is released, the valve element 1502 is pushed axially back to the right, and rotates again by interaction with between the slot 1506 and the pin 1510 back to closed, thereby allowing the structures 1552 to retract.

Figure 16:
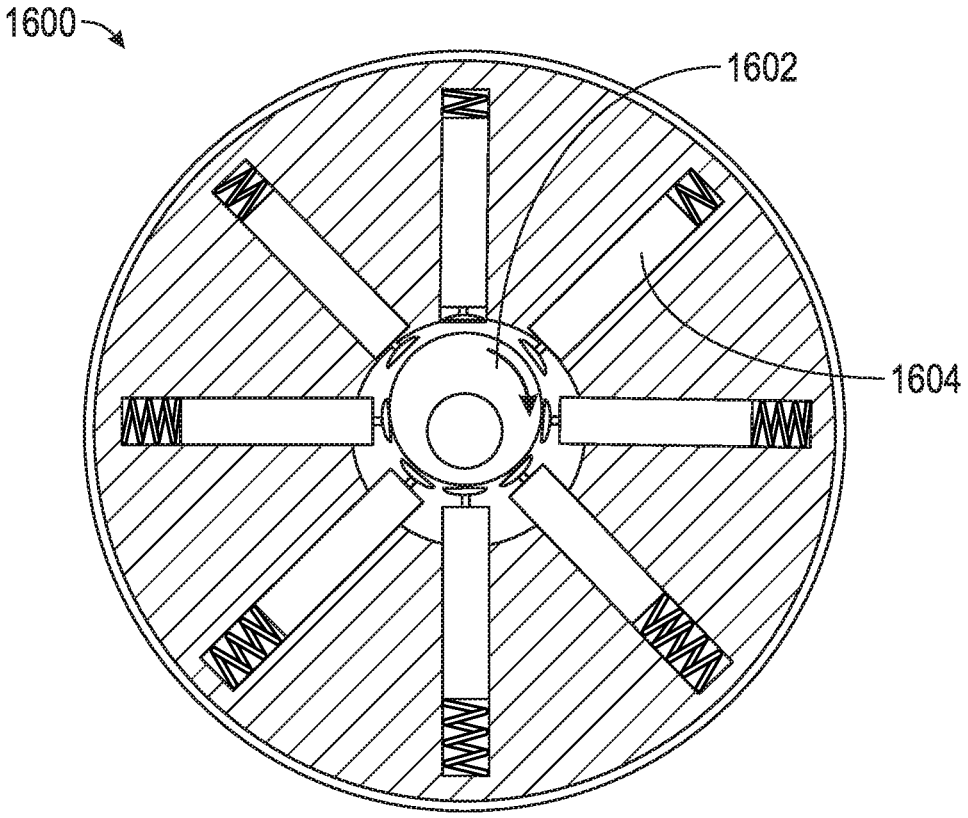
FIG. 16 illustrates a conceptual end view of an embodiment of a cam-piston valve actuator.

FIG. 16 illustrates a steering system 1600 which employs a mechanical actuation for radially extendable structures 1604 (e.g., pistons or pads), according to an embodiment. The structures may be oriented relative to the tool-face angle of the drill bit. While sliding, the structures can be actuated using drilling mud pressure to bias the drill string causing the system to drill a desired direction and dog leg (curve). The structures can be deactivated for periods when the drill string is rotating.

A valve may be employed, and may be changed mechanical between open and closed. The change in state of the valve can be achieved via axial or rotational movement. The change in valve state may be achieved by temporarily increasing mud pressure above a certain value to trigger the switching. One mechanism that may achieve this is a cam-piston system, as shown, which includes a rotatable cam 1602 and a plurality of internal pistons 1604. When circulating, pressure may act against an internal piston 1604 and cam system, which stops in a pre-defined location. Depending upon the location of the cam 1602, ports either align with ports to the piston chamber to activate the tool, or do not align with those ports, and no activation takes place. The tool is indexed through a sequence of pressures, which change the track upon which the cam piston is guided.

Figures 1, 17:
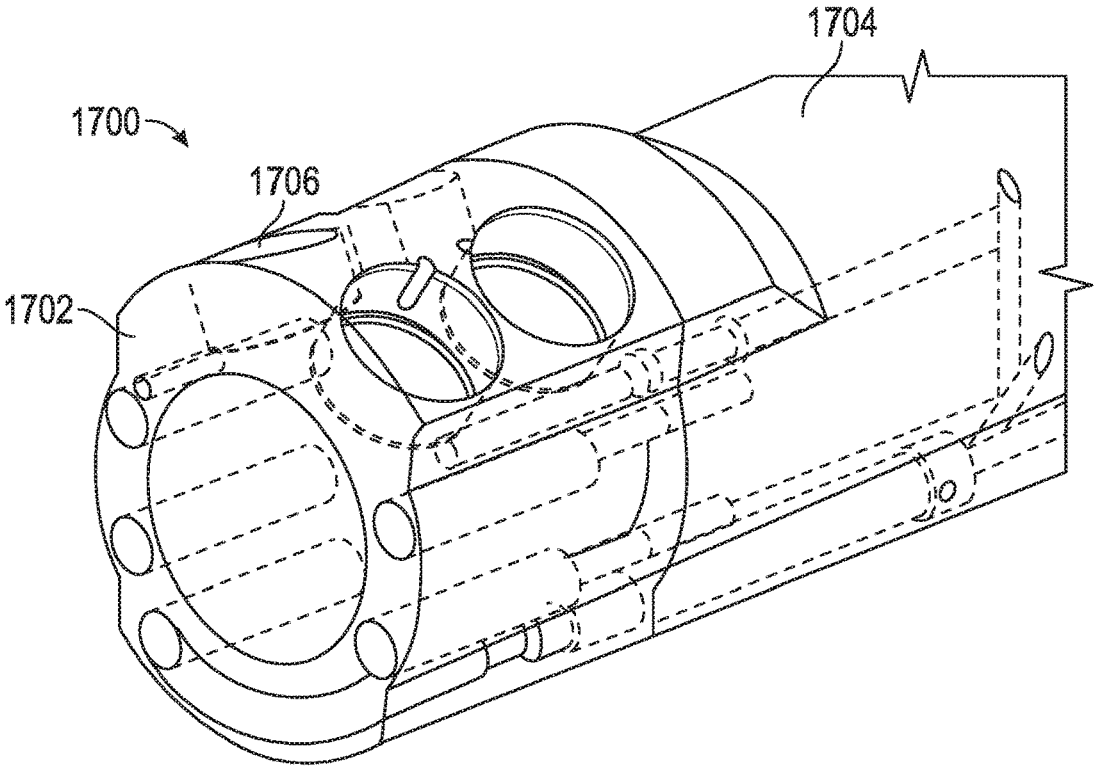
Figures 2, 17:
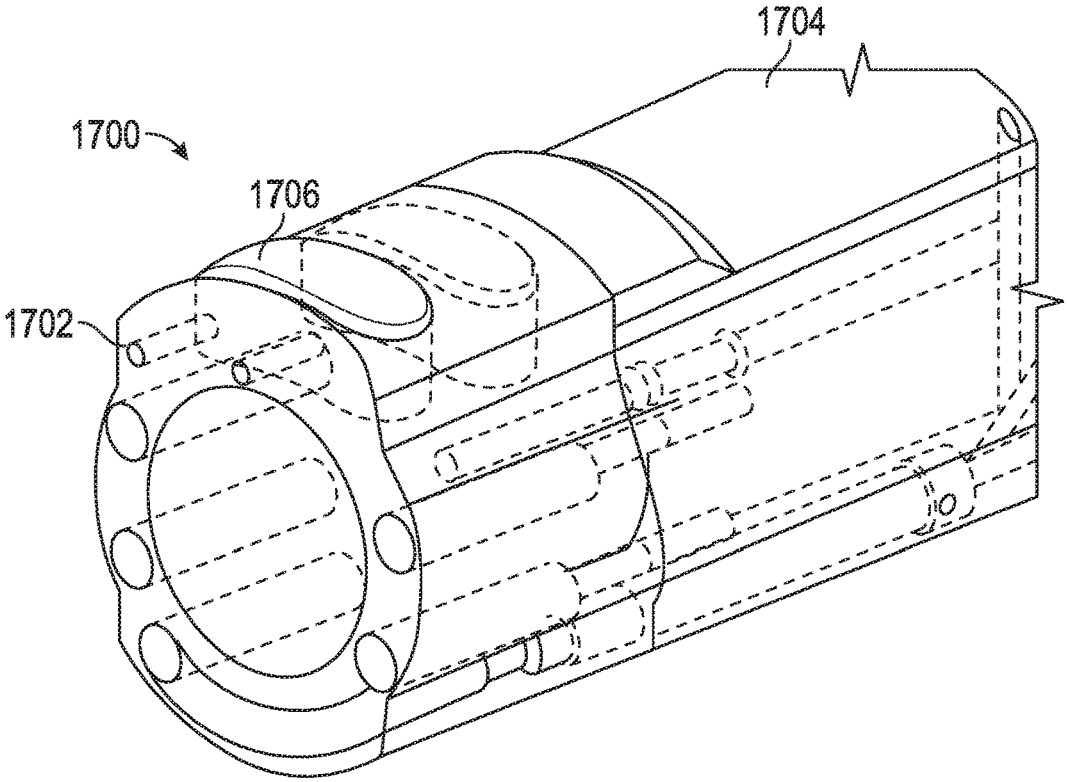

FIG. 17 illustrates a downhole steering system 1700, according to an embodiment. In this embodiment, a connector block 1702 of the system 1700, which may be a full ring, is attached to the lower end of a housing 1704 of the steering system 1700. The connector block 1702 can be connected in any suitable manner, such as by bolts, threaded in a way that the main ring body does not need to rotate so it can align with the exposed components, or another retention feature. The connector block 1702 contains the connectors and wiring as well as the radially-extendable structures 1706. The structures 1706 may be pistons (FIG. 17-1) or pads (FIG. 17-2).

Whereas certain embodiments have been described in particular relation to the drawings attached hereto, it should be understood that other and further modifications apart from those shown or suggested herein, may be made within the scope and spirit of the present disclosure.

What is claimed is:

1. A downhole steering system, comprising:

a substantially tubular housing;

a shaft positioned within the substantially tubular housing and rotatable with respect thereto;

a first bearing and a second bearing, the first and second bearings being configured to support rotation of the shaft relative to the housing, wherein the first bearing, the second bearing, the shaft, and the housing at least partially define a chamber therebetween;

at least one extendable structure positioned axially between the first and second bearing and being configured to extend from an exterior of the housing in response to pressure communicated to the chamber; and a control device configured to control pressure communication between the chamber and the at least one extendable structure, wherein the control device is positioned axially between the first and second bearings.

2. The downhole steering system of claim 1, wherein pressure is communicated to the chamber via one or more flow passages defined in the first bearing.

3. The downhole steering system of claim 2, wherein the first bearing comprises an inner journal and an outer housing, the inner journal and the outer housing defining a clearance therebetween that provides at least a portion of the one or more flow passages.

4. The downhole steering system of claim 2, wherein the second bearing defines one or more flow passages extending therethrough, so as to allow pressure communication with the chamber across the second bearing.

5. The downhole steering system of claim 4, wherein the first bearing is positioned uphole of the chamber, the second bearing is positioned downhole of the chamber, the first bearing is configured to maintain a first pressure differential, and wherein the second bearing is configured to maintain a second differential, the second differential being greater than the first differential.

6. The downhole steering system of claim 5, wherein the first bearing is positioned uphole of the chamber, and wherein the second bearing is positioned downhole of the chamber.

7. The downhole steering system of claim 2, wherein the one or more flow passages of the first bearing comprise a groove on a surface of the first bearing, the groove extending at least partially axially across the first bearing.

8. The downhole steering system of claim 1, wherein the control device is configured to communicate or block pressure communication between the chamber and the at least one extendable structure in response to a drilling fluid flow rate, a drill bit rotation speed, or both.

9. The downhole steering system of claim 1, wherein the control device comprises a biasing member and a valve element configured to block or allow communication between the chamber and the at least one extendable structure.

10. The downhole steering system of claim 9, wherein the valve element comprises an indexing slot, such that a downward stroke of the valve element causes a pin to advance in the indexing slot and rotate the valve, and wherein the biasing member is configured to force the valve element in an upstroke, so as to further advance the pin in the indexing slot and again rotate the valve.

11. The downhole steering system of claim 1, wherein the control device comprises one or more sensors configured to receive a communication from uphole of the control device, and wherein the control device is configured to actuate a valve in response to the communication to block or allow communication between the chamber and the at least one extendable structure.

12. The downhole steering system of claim 1, wherein the control device comprises one or more sensors configured to measure one or more of:

a distance extended or force exerted by the at least one extendable structure;

direction, inclination, angular position, rotation, lateral displacement, or a combination thereof, of the housing; or a property of a formation surrounding the housing.

13. The downhole steering system of claim 1, wherein the at least one structure comprises a piston that is located axially between the first and second bearings.

14. The downhole steering system of claim 1, wherein the shaft is secured to a drill bit and at least one cutting element is exposed on the shaft adjacent to the drill bit.

15. The downhole steering system of claim 1, wherein the shaft at least partially defines a hole extending radially from a hollow interior of the shaft to the chamber.

16. The downhole steering system of claim 1, wherein the shaft is secured to a drill bit, and the at least one extendable structure is axially positioned a distance from a distal end of the drill bit equal to or less than two times a diameter of the drill bit.

17. A drilling system, comprising:

a drill bit;

a shaft coupled to the drill bit, wherein rotation of the shaft causes the drill bit to rotate;

a substantially tubular housing positioned around at least a portion of the shaft between the drill bit and a mud motor of the drilling system, wherein the shaft and the drill bit are rotatable relative to the housing;

a first bearing and a second bearing, the first and second bearings being configured to support rotation of the shaft relative to the housing, wherein the first bearing, the second bearing, the shaft, and the housing at least partially define a chamber therebetween;

one or more radially-extendable pistons positioned axially between the first and second bearings and in pressure communication with the chamber, the one or more pistons being configured to extend outward of an exterior of the housing in response to pressure communicated to the chamber; and a valve configured to control pressure communication between the chamber and the radially-extendable pistons, wherein the valve is configured to actuate in response to a rotation speed of the housing, a drilling fluid pressure or velocity, or both, wherein the valve comprises:

a valve element, comprising an indexing slot, such that a downward stroke of the valve element causes a pin to advance in the indexing slot and rotate the valve; and a biasing member configured to force the valve element in an upstroke, so as to further advance the pin in the indexing slot and again rotate the valve.

18. A method for steering a drill bit, comprising:

deploying the drill bit and a downhole steering system into a wellbore, the downhole steering system comprising:

a substantially tubular housing;

a shaft positioned within the substantially tubular housing;

a first bearing and a second bearing, the first and second bearings being configured to support rotation of the shaft relative to the housing, wherein the first bearing, the second bearing, the shaft, and the housing at least partially define a chamber therebetween;

at least one extendable structure positioned axially between the first and second bearing and being configured to extend from an exterior of the housing in response to pressure communicated to the chamber;

flowing drilling fluid into the downhole steering system, between the shaft and the tubular housing, such that the shaft is rotated relative to the tubular housing, wherein rotation of the shaft causes the drill bit to rotate; and actuating a valve so as to allow pressure communication between the chamber and the at least one structure, such that the at least one extendable structure extends radially outward and engages a wellbore, wherein the valve is positioned axially between the first and second bearing.

* * * * *